US011013073B2

(12) United States Patent
Koetz

(10) Patent No.: US 11,013,073 B2
(45) Date of Patent: May 18, 2021

(54) SYSTEM FOR PREPARING AND METHOD FOR OPERATING A SYSTEM FOR PREPARING AT LEAST ONE FOOD

(71) Applicant: VORWERK & CO. INTERHOLDING GMBH, Wuppertal (DE)

(72) Inventor: Hendrik Koetz, Wetter (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 229 days.

(21) Appl. No.: 16/095,341

(22) PCT Filed: Apr. 20, 2016

(86) PCT No.: PCT/EP2016/058815
§ 371 (c)(1),
(2) Date: Oct. 19, 2018

(87) PCT Pub. No.: WO2017/182076
PCT Pub. Date: Oct. 26, 2017

(65) Prior Publication Data

US 2019/0141796 A1 May 9, 2019

(51) Int. Cl.
*H05B 6/64* (2006.01)
*H05B 6/70* (2006.01)
*H05B 6/72* (2006.01)

(52) U.S. Cl.
CPC ..... *H05B 6/6441* (2013.01); *H05B 6/6447* (2013.01); *H05B 6/70* (2013.01); *H05B 6/72* (2013.01)

(58) Field of Classification Search
CPC ..... H05B 6/6441; H05B 6/6447; H05B 6/70; H05B 6/72
(Continued)

(56) References Cited

U.S. PATENT DOCUMENTS

2011/0168695 A1 7/2011 Okajima et al.
2013/0080098 A1 3/2013 Hadad et al.
(Continued)

FOREIGN PATENT DOCUMENTS

CN 102124814 A 7/2011
CN 103843456 A 5/2014
(Continued)

OTHER PUBLICATIONS

European Office Action dated Jul. 31, 2019 for corresponding European application No. 16 717 395.4 with English translation.
(Continued)

*Primary Examiner* — Dana Ross
*Assistant Examiner* — Joseph W Iskra
(74) *Attorney, Agent, or Firm* — Intellectual Property Law Group LLP

(57) ABSTRACT

The invention relates to a system (100) for preparing at least one food (1, 2, 3) having a cooking chamber (10), in which the food (1, 2, 3) can be prepared, an energy unit (20), in order to carry out an supplying of electromagnetic energy into the cooking chamber (10) specific to the at least one food (1, 2, 3) in dependence on cooking information (4, 5, 6) of the at least one food (1, 2, 3), whereby the at least one food (1, 2, 3) can be brought into an edible state, wherein the energy unit (20) has at least two transmission antennae (30, 31, 32, 33), which are spaced apart from each other, can be actuated by at least one high frequency signal encoder of the system (100), and are designed to emit energy in the form of electromagnetic radiation in the microwave range into the cooking chamber (10) based on said actuation.

22 Claims, 9 Drawing Sheets

(58) Field of Classification Search
USPC ..... 219/702
See application file for complete search history.

(56) References Cited

U.S. PATENT DOCUMENTS

| | | | |
|---|---|---|---|
| 2015/0351164 | A1 | 12/2015 | Wesson et al. |
| 2016/0051078 | A1 | 2/2016 | Jenkins et al. |

FOREIGN PATENT DOCUMENTS

| | | | | |
|---|---|---|---|---|
| CN | 105142255 | A | | 12/2015 |
| CN | 105373032 | A | | 3/2016 |
| WO | WO 2012/066419 | A1 | | 5/2012 |
| WO | WO2012066419 | | * | 5/2012 |
| WO | WO 2012/073113 | A2 | | 6/2012 |
| WO | WO2012073113 | | * | 6/2012 |
| WO | WO 2013/033330 | A2 | | 3/2013 |
| WO | WO 2015/196218 | A1 | | 12/2015 |
| WO | WO2015196218 | | * | 12/2015 |

OTHER PUBLICATIONS

International Search Report, dated Dec. 15, 2016 for corresponding International Application No. PCT/EP2016/058815 with English translation.

Written Opinion, dated Dec. 15, 2016 for corresponding International Application No. PCT/ EP2016/058815.

China Office Action dated Jan. 4, 2021 for corresponding China application No. 201680084696.8 with English summary translation, pp. 1-15.

European Office Action dated Jan. 14, 2021 for corresponding European application No. 16 717 395.4 with English summary translation, pp. 1-7.

* cited by examiner

SYSTEM FOR PREPARING AND METHOD FOR OPERATING A SYSTEM FOR PREPARING AT LEAST ONE FOOD

CROSS-REFERENCE TO RELATED APPLICATIONS

This application is a U.S. National Phase application, under 35 U.S.C. § 371, of International Application no. PCT/EP2016/058815, with an international filing date of Apr. 20, 2016, which is hereby incorporated by reference for all purposes.

BACKGROUND OF THE INVENTION

1. Field of the Invention

The present invention relates to a system for preparing at least one food, comprising a cooking chamber in which the food can be prepared, and an energy unit to carry out a supply of electromagnetic energy, specific to the at least one food, into the cooking chamber dependent upon cooking data of the at least one food, whereby the at least one food can be brought into an edible state. Furthermore, the invention relates to a method for operating such a system for preparing at least one food.

2. Background

Food, which is put in conventional food preparation devices, such as a microwave or an oven, can usually be heated only in a uniform manner. Regardless of their size, weight and type, the food is uniformly heated with top heat/bottom heat, by fan mode (oven) or microwave radiation, even though the food is sub-divided into a main course, e.g. meat, and one or more-side dishes, e.g. rice or potatoes, and requires different temperatures or cooking periods in order to become cooked or be heated at the same time.

Conventional microwaves heat food using a magnetron, or through the energy of electromagnetic waves generated by a magnetron. A microwave comprises a static frequency and a static phase of the electromagnetic waves, which results in differently pronounced temperature zones inside the cooking chamber. In order to heat the food in a most uniform manner, the microwave uses a rotary plate and/or a type of stirrer/ceiling fan to distribute the waves in the cooking chamber. The penetration depth of microwaves depends on the density of the food to be cooked. Thus, loose dishes such as products of ground meat, mashed potatoes etc. are heated faster in the microwave than dense dishes, such as a solid piece of meat, lasagna, etc. of the same mass. Thus, the disadvantage in such microwaves is that some parts of the heated food become very hot, while other parts, such as meat, become lukewarm, at best, while heated simultaneously.

In conventional baking ovens with fan mode and/or top and bottom heat, the different parts of a food are also all applied with the same heat, which also results in that some parts of the food to be heated are heated more intensely than other parts because of their type, size, weight, in particular their density.

SUMMARY OF THE INVENTION

Thus, the object of the present invention is to resolve the existing disadvantages of the above-mentioned conventional food preparation devices. In particular, a system for preparing at least one food as well as a method for operating a system for preparing at least one food are to be created, which, in the heating of food or food stuff with different food components, enable that all food components or foods reach a defined, in particular the same, cooking state and the same eating temperature at the same time. It is to be achieved by the system and the method that a homogenous temperature distribution is created in different food components or foods of a cooked food, without moving the food to be cooked.

The object is achieved by the claims. In particular, the object of the invention is achieved by a system for preparing at least one food having the features of claim 1 as well as by a method for operating a system for preparing at least one food having the features of claim 16. Further features and details of the invention result from the dependent claims, the description and the drawings. Features and details described in conjunction with the system according to the invention naturally also apply in conjunction with the method according to the invention, and vice versa, so that in terms of the disclosure, reference is or can always mutually be made to the individual aspects of the invention.

According to a first aspect of the invention, the object is achieved by a system for preparing at least one food. The system comprises a cooking chamber, in which the food, i.e. the food product or the cooked food, can be prepared. Furthermore, the system comprises an energy unit, to carry out a supply of electromagnetic energy, specific to the at least one food, into the cooking chamber dependent upon the cooking data of the at least one food, whereby the at least one food can be brought into an edible state. Furthermore, the system is characterized in that the energy unit comprises at least two spaced transmission antennae, which can be actuated by at least one high-frequency signal transmitter of the system, and which are configured to emit energy in the form of electromagnetic waves in the microwave range into the cooking chamber based upon this actuation.

Such a system for preparing at least one food allows bringing a food to be heated, or multiple different foods, which together are to be heated as cooked food, to a defined, in particular the same cooking state and the same eating temperature at the same time. The system enables that a homogenous temperature distribution is created in different food components or foods of a cooked food, without that the cooked food is moved. All different foods, such as meat as a main course, and rice and peas as two different side dishes, which are positioned together in the cooking chamber, preferably on a plate, can be brought into the same cooking state and the same eating temperature by means of the system. This is achieved by the special energy unit. Said unit comprises at least two or more spaced transmission antennae. The at least two transmission antennae can be actuated by at least one high-frequency signal transmitter of the energy unit of the system. The high-frequency signal transmitter may comprise multiple outputs. The at least one high-frequency signal transmitter transmits energy into an oscillating circuit, wherein a magnetic field is created around a conductor. The transmission antennae emit the energy in the form of electromagnetic waves with a specific and likewise determinable frequency into the cooking chamber. A system in which each transmission antenna is actuated by in each case one high-frequency signal transmitter is preferred. Each individual transmission antenna is configured to emit energy in the form of electromagnetic radiation in the microwave range into the cooking chamber based upon the actuation of the one or multiple high-frequency signal transmitter(s). Preferably, the at least one high-frequency signal transmitter is configured to emit a constant signal, in particular a signal with 2.35 to 2.45 GHz. The high-frequency signal transmitters emit high-frequent sinusoidal oscillations. The high-frequency signal transmitters provide the option of a frequency and amplitude modulation. Furthermore, by the actuation, the phases of the electromagnetic waves can be individually determined or set in each transmission antenna.

Due to the fact that at least two transmission antennae spaced from one another are provided, electromagnetic waves are periodically emitted into the cooking chamber on at least two points. These waves encounter one another, so that interferences occur. Thus, an amplification or weakening of the electromagnetic radiation can occur. In other words, depending on how many transmission antennae emit electromagnetic radiation into the cooking chamber, radiation zones or regions can be created, in which the electromagnetic radiation is very high, and there can be created radiation zones or regions, in which the electromagnetic radiation is lower. This effect can be used in accordance with the invention. In other words, using the system, certain regions or zones inside the cooking chamber can be radiated more intensely than other regions or zones. Thus, foods that have a higher density, e.g. meat, can be radiated more intensely and/or longer in the cooking chamber than foods with a lower density, such as vegetables. Due to the fact that two, however preferably more than two, transmission antennae are provided, which are arranged on the cooking chamber in such a way that they emit their electromagnetic radiation into the cooking chamber and thereby towards the foods positioned in the cooking chamber for heating, two or more different radiation zones can be created in the cooking chamber. As a consequence, different foods, which are simultaneously positioned in the cooking chamber, can be exposed to the electromagnetic radiation at different intensities. This in turn leads to a situation where different foods, such as meat, pasta and peas, can all at the same time reach the same cooking state and a same eating temperature.

Heating of the foods is based on the dielectric effect. The foods comprise polar molecules. Such molecules have a non-uniform distribution of positive and negative charges. In other words, there are regions in the molecules where a greater number of positive charges prevails, and regions where there are a greater number of negative charges. In the case that such molecules are radiated with electromagnetic waves, they orient themselves in accordance with the flux lines of the electromagnetic field. In the event that the electromagnetic field changes in polarity, they turn around themselves in order to be re-oriented. In other words, in the foods, charge carrier of the molecules can follow the directional changes of the high-frequency field only with a certain delay, which causes an increase of the internal energy in the foods and thus their temperature.

The energy unit according to the invention of the system allows the supply of electromagnetic energy, specific to the at least one food, into the cooking chamber dependent upon cooking data of the at least one food, whereby the at least one food can be brought into an edible state. In the case that multiple foods are to be heated, which is the case in most classic food products, the energy unit enables that all foods reach their cooking state and the same eating temperature at the same time.

The more transmission antenna and the more high-frequency signal transmitters are present, the more different radiation zones can be formed inside the cooking chamber, whereby a plurality of different foods can be brought into the cooking state simultaneously.

It is conceivable that the at least two transmission antennae are provided with energy by one and the same high-frequency signal transmitter. The latter comprises multiple separate outputs then. The transmission antennae and the high-frequency signal transmitters are preferably connected to one another via a conductor, i.e. an electrically-conductive cable. The high-frequency signal transmitter outputs a constant signal to the transmission antennae. Depending on how they are turned-on and -off, the emission characteristic of the electromagnetic radiation in the cooking chamber can be influenced. However, an energy unit in which each transmission antenna is connected to a distinct high-frequency signal transmitter, is preferred. As a result, the radiation characteristic can be influenced not only by the transmission antennae per se, but also by the high-frequency signal transmitters, in that these are turned-on and off.

By the number of the transmission antennae and their arrangement on the cooking chamber, and by the actuation of the transmission antennae through the one or more high-frequency signal transmitters or a direct actuation of the transmission antennae, or by turning-on and -off the transmission antennae, individual radiation zones or temperature zones can be created inside the cooking chamber, which are adapted exactly to the cooking data of the foods positioned in the cooking chamber. This enables that all foods positioned in the cooking chamber are heated in such a way that they simultaneously reach the same defined cooking state and a same eating temperature.

According to a preferred development of the invention, it can be provided in a system that at least one of the transmission antennae, or preferably each transmission antenna, is operatively assigned a power amplifier for amplifying the electromagnetic radiation of the respective transmission antenna. The power amplifiers enable to reproduce the modulated input high-frequency signal at the transmission antenna output in an amplified manner without power losses. The at least one power amplifier can be configured as a non-linear or as a linear power amplifier. The power amplifiers can in particular be configured in such a way that a control, in particular an amplification, of the radiated power is made possible by them.

Furthermore, in a preferred system, it can be provided that the said system comprises a control unit which controls the actuation of each transmission antenna through the at least one high-frequency signal transmitter. Of course, two or more control units can also be provided. Particularly preferably, each transmission antenna is connected to a high-frequency signal transmitter assigned to it. The control unit can actuate each individual high-frequency signal transmitter, i.e. turn it on and off. As a result, the control unit can determine the time periods in which a transmission antenna outputs, or does not output, electromagnetic radiation. However, depending on the requirements, the control unit can directly actuate the transmission antennae and turn them on or off correspondingly. In particular, the radiation period of each transmission antenna can be controlled and the phases of the electromagnetic waves can be altered by the at least one control unit.

As a result, the at least one control unit thereby enables a supply of electromagnetic radiation, specific to the at least one food, into the cooking chamber dependent upon cooking data of the at least one food. In other words, the control unit influences or controls the radiation zones or temperature zones inside the cooking chamber, in that it ensures, whether and which transmission antenna emits electromagnetic radiation at what time. As a result, if the exact position of the individual foods in the cooking chamber is known, the system can assign a specific radiation to each food so that all foods positioned in the cooking chamber can reach their cooking state and the same eating temperature simultaneously.

According to a further preferred development of the invention, it can be provided in a system that the control unit is configured to turn-on and -off at least one transmission antenna or each transmission antenna for the control of the emission of electromagnetic radiation individually or in groups, and/or that the control unit is configured to turn-on or -off at least one high-frequency signal transmitter of the system for the output of signals to the at least one transmission antenna. In other words, depending on the requirements, the at least one control unit can turn individual transmission antennae or high-frequency signal transmitters, in the case that each transmission antenna is assigned a distinct high-frequency signal transmitter, or groups of transmission antenna or high-frequency signal transmitters on and off. As a result, the control unit can influence the radiation characteristic of each and thus the temperature zones existing in the cooking chamber during the heating of the foods. Thus, so-called hot-spots can be generated inside the cooking chamber, which can, as a matter of precaution, be used to heat denser foods. Through a targeted actuation of the electromagnetic radiation of the transmission antennae, each different food positioned in the cooking chamber in order to be heated can be provided with an electromagnetic radiation specifically adapted to this food.

It can preferably be provided in a system that the at least one transmission antenna or each transmission antenna and/or the one or more high-frequency signal transmitters can be actuated by the control unit in such a way that predetermined constructive interferences or destructive interferences of the electromagnetic radiations emitted by the transmission antennae result in the cooking chamber for the formation of radiation zones or temperature zones in the cooking chamber. In other words, the at least one control unit can control the radiation characteristic of each transmission antenna in such a way that either constructive interferences or destructive interferences of the electromagnetic radiation or waves result in predetermined regions inside the cooking chamber. The at least one control unit can determine, by a targeted actuation of the transmission antennae and/or high-frequency signal transmitters, where in the cooking chamber the electromagnetic radiations are amplified by interferences, and where they are weakened. As a result, so-called hot-spots can be generated, in which a high temperature level prevails in order to more intensely heat foods which heat-up slower due to their type, size and weight. Accordingly, radiation zones or temperature zones can be created, in which a lower or medium temperature level prevails, in order to more slowly heat foods which heat-up faster due to their type, size and weight.

The transmission antennae are preferably arranged on the cooking chamber in such a way that the foods positioned in the cooking chamber can be radiated from all sides, if possible. Likewise, the number of provided transmission antennae is flexible. For example, four or more transmission antennae can be arranged in the upper region of the cooking chamber, which radiate the foods from above, or obliquely from above. However, it is also conceivable that the transmission antennae are arranged laterally or in the lower region of the cooking chamber in order to radiate the foods from the side or from below. The cooking chamber is hermetically sealed during the radiation, and thus forms a closed structure. An opening is provided to add or remove foods, and the opening can be closed during the heating process in order that no electromagnetic radiation can escape from the cooking chamber.

According to a further preferred development of the invention, it can be provided in a system that at least one transmission antenna or multiple transmission antennae are moveable in the system relative to the cooking chamber individually or in groups by means of one or multiple drives, in particular two-dimensionally or three-dimensionally. The position of the one or more transmission antenna(e) can be changed thereby. For one, this allows changing the distance of the one or other transmission antennae relative to the foods. On the other hand, phases and thus the interferences of the electromagnetic waves are influenced thereby, whereby the structure of the radiation zones or of the temperature zones can be changed in turn. The drives in particular can be motors such as actuating motors or linear motors. By the movement, in particular the displacement, of transmission antennae, e.g. a concentration of the input energy, i.e. of the electromagnetic radiation, can be caused. Transmission antennae can deliberately be positioned relative to one another in such a way that certain radiation cones or radiation lobes can be generated, where a high temperature level prevails.

Furthermore, it can be provided in a system that the said system comprises a setting device, in particular a touchscreen, to enter input parameters of the at least one food or of the cooking chamber, that the setting device is coupled to the control unit in a data-communicating manner for the transmission of the input parameters entered, and that the control unit is configured to generate different radiation zones and radiation periods adapted to the at least one food inside the cooking chamber based upon the transmitted input parameters of the at least one food. The setting device allows the user of the system to actively intervene in the heating process to follow. In other words, the user can, e.g. via a touchscreen, i.e. a screen with touch input, communicate a plurality of different input parameters to the system. In this way, the user can specify exactly what kind of food is positioned where in the cooking chamber, and how these foods can be radiated separately from one another in a targeted manner. The setting device preferably is configured to enter at least one of the following parameters of the at least one food as an input parameter for the control unit:

type
size
weight
density
quantity
position in the cooking chamber
target temperature Additionally or alternatively, the setting device can be configured to enter the input of the electromagnetic radiation for different radiation zones or temperature zones inside the cooking chamber. In order that the entered input parameters arrive at the control unit, the setting device is connected to the control unit in a data-communicating manner. This can be effected in a wired or wireless manner. Based upon the transmitted input parameters of the at least one food, the control unit determines, how intensively and how long the corresponding food is to be radiated with electromagnetic radiation by the various transmission antennae, and adjusts the radiation zones and radiation periods in accordance with the requirements by actuation of the transmission antennae and/or the high-frequency signal transmitter. As a result, it can be ensured that all foods to be heated simultaneously in the cooking chamber reach the cooking state and the same eating temperature at the same time. It is also possible that the user themselves enters the ways and manners how which zone is to be radiated. In particular, the user can decide what temperature is to prevail in which zones of the cooking chamber in the later heating process. This requires a certain help by the user, because the user is to position the individual foods correspondingly in the cooking chamber, in order that they all become done at the same time. If, for example, the user only wants to heat water in a glass, they can enter, via the setting device, that only a certain zone in the cooking chamber, where the glass is positioned, is intensively heated in order to save energy.

According to another preferred development of the invention, it can be provided in a system that the system comprises an object recognition for the automatic determination of at least one of the following parameters of the at least one food, as an input parameter for the control unit:

Size
Density
quantity
position in the cooking chamber that the object recognition is coupled to the control unit in a data-communicating manner for the transmission of the automatically determined input parameters to the control unit, and that the control unit is configured to generate different radiation zones and radiation periods, adapted to the at least one food, inside the cooking chamber by means of the transmission antennae based upon the transmitted input parameters of the at least one food.

Through the object recognition, foods can automatically be recognized by the system. This provides a great advantage for the user. The user does not have to enter input parameters via the setting device, but the object recognition per se determines at least some of the input parameters of a food. The object recognition can serve to support the setting device. As a result, entering input parameters is made a lot easier for the user. The object recognition can be coupled to the setting device in a data-communicating manner. In this way, the object recognition can display some of the input parameters it determined on a screen of the setting device for the user. The user can supplement missing input parameters or insert additional input parameters. In particular the recognition of the position of the individual foods in the cooking chamber is a huge help for the user.

The object recognition preferably comprises at least one camera. As an alternative or in addition to the at least one camera, the object recognition may comprise one or multiple sensors, which are capable of recognizing the position or the size of food. The sensors can be optical sensors, for example. Furthermore, capacitive sensors such as pressure sensors, inductive sensors, such as force sensors, or mechanical sensors, such as a scale, can be provided. All of these sensors serve to recognize the foods. The object recognition is coupled to the control unit in a data-communicating manner for the transmission of the automatically detected input parameters to the control unit. As a result, the control unit may receive all relevant input parameters about the foods positioned in the cooking chamber, based upon which the control unit can determine how the radiation characteristic is to look like, in order to make sure that all food positioned in the cooking chamber are done and have the same eating temperature at the same time.

Furthermore, according to a further development of the invention, it can be provided in a system that the system comprises a determination device for determining the weight of the at least one food, that the determination device is coupled to the control unit in a data-communicating manner for the transmission of the detected weight of the at least one food, and that the control unit is configured to automatically generate different radiation zones and radiation periods, adapted to the weight of the at least one food, inside the cooking chamber by the transmission antennae based upon the transmitted weight of the at least one food. The determination device can be arranged differently, depending on the system. For example, the determination device can be placed outside the cooking chamber. Alternatively, the determination device can be arranged in the lower region of the cooking chamber in order to determine the weight of the food immediately after the positioning thereof in the cooking chamber. The determination device can be configured to determine the tare weight of the food based upon a previously known weight of a food carrier, such as a plate. The determination device may comprise a weighting device, for example. Additionally, the determination device can comprise a detection device for recognizing at least one food carrier couplable with the system. The weight of the food placed on the food carrier can be calculated by means of a computing unit, which is coupled to the recognition device and the determination device. Through the data-communicating connection between the determination device and the control unit, the weight data can be forwarded to the control unit, which accordingly can draw conclusions on the required radiation then. The determination device can be subdivided into segments, in order to be able to determine the weights of individual foods with a correspondingly formed food carrier. The recognition device can be a code scanner, a camera, an NFC module, or a magnetic switching module for the recognition of the food carrier.

A further preferred system may comprise a database, which is coupled to the control unit in a data-communicating manner and from which, by the control unit, cooking data can be read based upon the input parameters of the at least one food. The database may comprise a storage device, in which input parameters of foods can be stored for comparison. The system, in particular the database, may further comprise a communication device for collecting food-specific data and input parameters via the internet or another wired or wireless network. The control unit can identify cooking data of the corresponding foods via the database, so that a corresponding actuation of the energy unit can be effected based upon the cooking data, in order to individually set the required radiation by the transmission antennae for each food. The system can comprise a comparing device, which is connected to the control unit in a data-technical manner. In this way, the control unit can compare input parameters entered with comparison parameters from the database in order to determine the exact cooking data for each food.

As previously mentioned, the cooking chamber is hermetically sealed during the performing of the electromagnetic radiation and thus forms a closed structure. Thus, the cooking chamber can be bounded by a housing, in particular a rectangular cuboid, of the system. The housing comprises a bottom, side walls and a ceiling. For the access to the cooking chamber, the system preferably comprises an openable and closable door. The door is preferably pivotally arranged on the housing. The transmission antennae are preferably arranged on the housing in such a manner, in particular secured, that the electromagnetic radiation emitted by the transmission antennae can be output into the cooking chamber surrounded by the housing. Likewise, the high-frequency signal transmitters and the power amplifiers can be mounted on the housing. The transmission antennae are preferably arranged on the ceiling of the housing. Alternatively or additionally, they can likewise be arranged on the side walls or on the bottom. The same applies to the high-frequency signal transmitters and to the power amplifiers.

According to a further system, it can be provided that the said system is a cooking device, in particular a food preparation device, which comprises the cooking chamber and/or the energy unit and/or the object recognition and/or the setting device and/or the determination device and/or the database and/or the comparing device, in particular that the cooking device is an oven. The system may additionally comprise a grill and/or heating coils for generating top and bottom heat and/or a heat source with a fan for the generation of fan-mode heat. In this way, foods of any type can be heated for eating in a simple, cost-efficient and fast manner. In particular, a dish containing multiple foods can be brought into an optimum cooking state for all of these foods of the dish by such a system.

The cooking device itself preferably also comprises walls, which can enclose the cooking chamber, the energy unit, the object recognition, the setting device, the determination device, the database and/or the comparing device.

The above described system is configured to bring food into a perfect cooking state. The system enables generating a homogeneous temperature distribution within the dishes, without the necessity of a rotary plate or other moveable devices for the distribution of energy in the cooking chamber during the heating.

The basis for the generation of different temperature zones inside the cooking chamber is high-energetic radio technology. Compared with a microwave, which only comprises one generating element and thus results in a non-changeable temperature distribution, the electromagnetic radiation from a plurality of transmission antennae enables to bundle energy and thereby generate different radiation or temperature zones inside the cooking chamber. Via a preferably matrix-like structure of high-frequency signal transmitters, possibly power amplifiers and transmission antennae, which emit electromagnetic radiation, different foods can be individually heated at the same time. An array of transmission antennae is preferably mounted below the ceiling of the housing of the cooking chamber, which are capable of emitting electromagnetic energy generated by one or multiple high-frequency signal generators. By the targeted combination of the different transmission antennae, i.e. a targeted turning-on and -off of the individual transmission antennae or possibly of the high-frequency signal generators, it is possible to generate different radiation zones and thus temperature regions inside the cooking chamber based upon the superposition principle by constructive and destructive interferences. The temperature distribution inside the cooking chamber can be controlled depending on the requirement by the at least one control unit.

The transmission antenna, preferably above the cooking chamber, can either be mounted statically, or be adjusted by means of suitable drives, in particular actuators, along one or multiple axes. Using the orientable transmission antennae, the concentration of the input energy can be increased, or different radiation cones or radiation lobes can be formed (beamforming).

The above described system is configured to change the phase, amplitude and/or the frequency of the electromagnetic wave emitted by a transmission antenna. This can be controlled by the control unit. In particular, the frequency, the phase, the amplitude of a radiated electromagnetic wave can be influenced by a high-frequency signal transmitter and/or by a power amplifier assigned to the transmission antenna.

In generally, the lower the frequency of an electromagnetic wave for cooking, the higher the penetration depth, but the lower the absorption. If the frequency is too high, the penetration depth is small, and only the surface of the food is heated.

In order to heat the interior of a cooked food, i.e. of the foods, and as well cook the outer side of a food till crispy, different frequency ranges or different heating elements are required. This can be achieved by a system, which additionally comprises a grill and/or heating coils for the generation of top and/or bottom heat and/or a heat source with a fan.

According to a particularly advantageous development of the invention, it can be provided in a system that at least one of the transmission antennae of the energy unit or at least one additional transmission antenna of the energy unit, which can be actuated by at least one high-frequency signal transmitter of the system or at least one additional high-frequency signal transmitter of the system, is configured to output energy in the form of electromagnetic energy in the terahertz range into the cooking chamber based upon the said actuation. Such a system can cover both the microwave frequency range, i.e. in particular the frequency range from 2 GHz to 3 GHz, for the cooking of food from inside, and the terahertz range, i.e. in particular the frequency range from 1 THz to 10 THz, for roasting the food from outside. Different foods can thereby be brought into an optimum cooking state simultaneously and, additionally, be cooked till crispy.

Furthermore, it can be provided in a system, in a development of the invention, that at least one of the transmission antennae comprises a radiation funnel for the oriented radiation of electromagnetic waves, that the said at least one transmission antenna is supported to be pivotable about an axis of rotation, and the said at least one transmission antenna is coupled to the control unit in a data-communicating manner in order to be actuated by the control unit. A radiation funnel allows controlling the radiation of the electromagnetic radiation of a transmission antenna. In particular, the emitted electromagnetic radiation can be directed to a certain region inside the cooking chamber, and thereby to a selected food. Thus, each individual food can be heated even more individually. By the pivotability of the radiation funnel, the orientation of the radiated electromagnetic radiation can be adapted according to the requirements.

According to a further aspect of the present invention, the object is achieved by a method for operating a system according to a first aspect of the invention, as described above. The method comprises the following steps:

- at least one food is positioned in the cooking chamber of the system,
- the at least two transmission antennae, which are spaced from one another, are actuated by the at least one high-frequency signal transmitter,
- based upon the actuation by the at least one high-frequency signal transmitter, the transmission antennae emit energy in the form of electromagnetic radiation onto the cooking chamber of the system, wherein the actuation of the at least one high-frequency signal transmitter and/or of the at least one transmission antenna occurs dependent upon cooking data of the at least one food, whereby the at least one food is brought into an edible state.

The method according to the invention provides the same advantages as have been described in detail with respect to the system according to the invention according to the first aspect of the invention.

One or multiple foods, e.g. a main course, such as meat, and tow side dishes, such as peas and dumplings, are positioned in the cooking chamber of the system. Subsequently, the transmission antennae are actuated by the at least one high-frequency signal transmitter, preferably by in each case one high-frequency signal transmitter. In doing so, the at least one high-frequency signal transmitter transmits energy, i.e. magnetic field energy, to the transmission antennae. The transmission antennae emit this energy in the form of electromagnetic radiation into the cooking chamber of the system. Since multiple transmission antennae are actuated, these antennae emit the said electromagnetic radiation in each case in the form of electromagnetic waves in the direction of food positioned in the cooking chamber. In other words, the electromagnetic waves of one transmission antenna propagate in the cooking chamber in the direction of the food. The electromagnetic waves of the different transmission antennae are subject to interference with one another in the cooking chamber. Depending on the wavelength and the phase of the waves, when and from where the electromagnetic waves of the different transmission antennae are emitted, or when and where they encounter in the cooking chamber, destructive or constructive interferences are formed. In other words, by the superposition of the electromagnetic waves in the cooking chamber, the electromagnetic radiation can be intensified in some regions, or be lowered in some regions. Thus, radiation zones of different radiation intensity can be created inside the cooking chamber. The electromagnetic radiation and thus the temperature level are high in so-called hot-spots, while a lower electromagnetic radiation and a lower temperature level prevail in other radiation zones.

By the actuation of the transmission antennae by the at least one high-frequency signal transmitter, in the method, depending on the cooking data of the at least one food, these are radiated at different intensities with electromagnetic radiation. In the method, this can be controlled in such a way that after all, the different foods, which are radiated simultaneously, have the same cooking state and the same eating temperature at the same point of time. This method allows heating dishes with different foods in such a way that these foods all have the same temperature and have reached a cooking state optimal for each food. A user has a significant advantage compared to a conventional heating of food using a microwave. In the microwave, after completion of the heating process, the different foods of a dish would be differently done and be differently hot. While a water-containing side dish such as peas would be very hot, a slice of meat would be merely lukewarm.

According to a preferred development of the invention, it can be provided in the method that, depending on the requirements on the energy to be supplied for the at least one food, the power amplifier of the at least one transmission antenna amplifies the electromagnetic radiation emitted by the transmission antenna. The power amplifier can amplify the amplitude of the signal sent to the transmission antenna and thus change the characteristic of the radiated electromagnetic radiation or of the electromagnetic waves. Depending on the ways and manners how a power amplifier changes the incoming signal, likewise the interference pattern of the superposition of the electromagnetic waves of different transmission antenna in the cooking chamber changes. In other words, it is possible, in the method, to change the intensity of radiation in certain zones in the cooking chamber depending on the requirements of heating of foods and their cooking data, by a targeted actuation of one or more power amplifiers. The actuation of the transmission antennae, the high-frequency signal transmitter and/or of the power amplifiers preferably occurs through the control unit of the system.

Particularly preferably, it can be provided in a method that input parameters of the at least one food are forwarded to the control unit of the system, that the control unit controls the energy required to heat the at least one food by turning-on and -off the transmission antennae and/or by turning-on and -off the high-frequency signal transmitters, wherein each transmission antenna is operatively assigned in each case one high-frequency signal transmitter. In other words, the control unit of the system receives the input parameters of a food. The input parameters can be the name, the size, the weight, the density, the quantity, the position of the food in the cooking chamber, and/or the target temperature, etc. Based upon this data, the control unit can actuate the transmission antennae and/or the high-frequency signal transmitters in such a way that a radiation optimal to the respective food in the cooking chamber results by electromagnetic waves. In the case that multiple foods with different input parameters are simultaneously positioned in the cooking chamber of the system, the control unit controls the transmission antennae and/or the high-frequency signal transmitters and possibly also the power amplifiers in such a way that a radiation characteristic results inside the cooking chamber that ensures that the different foods reach the same cooking state and the same eating temperature after the same radiation period for all foods at the same time. To that end, the control unit selectively turns the transmission antennae and/or the high-frequency signal transmitters on and off in accordance with the cooking data for each food. Due to turning-on and -off of the transmission antennae and/or by the turning-on and -off of the high-frequency signal transmitters, the control unit actively influences the electromagnetic radiation emitted by the transmission antennae and thus the different temperature zones distributed in the cooking chamber.

Preferably, it can further be provided in a method that the control unit reads cooking data of the at least one food based upon the input parameters of the at least one food and generates, based upon this cooking data, radiation zones and radiation periods, adapted to the at least one food, inside the cooking chamber by the transmission antennae based upon these cooking data. As a result, the control unit receives exact information for the actuation of the energy unit, i.e. the actuation of the transmission antennae, the high-frequency signal transmitters and/or possibly the power amplifiers. In this case, the cooking data for a food can be different. In other words, if only one single food is to be heated, the control unit reads corresponding cooking data from the database based upon the input parameters for this food, and subsequently actuates the energy unit based upon the read cooking data. However, if two or more different foods are to be heated, a correspondingly adapted actuation of the energy unit is to be effected by the control unit. In other words, the control unit reads other cooking data for the respective foods as compared to a case where only one single food is to be heated. The database contains preferably cooking data for each known food, but also cooking data for any possible combination of two or more foods.

The transmission antennae, the power amplifiers and/or the high-frequency signal transmitters of the system can be actuated by the control unit in such a way, in particular turned-on and -off, that radiation zones and radiation periods adapted to the food positioned there, in particular temperature zones adapted to the foods, are generated based upon the superposition principle of the constructive interference and destructive interference of the waves of the electromagnetic radiation of the transmission antennae in the cooking chamber.

Preferably, it can be provided in a method that the input parameters of the food and/or of the cooking chamber are input via the setting device, in particular the touchscreen, and are forwarded to the control unit and/or that the input parameters of the food and/or of the cooking chamber are automatically determined and forwarded to the control unit by the system based upon the object recognition and/or the determination device. Via the setting device, a user can actively enter input parameters of the food and/or of the cooking chamber into the system. In this way, the user can specify the weight of a corresponding food and the location of this food in the cooking chamber of the system. Furthermore, the user can also directly indicate, independently of the food, which temperature distribution they want to have in the cooking chamber. This is advantageous if the user knows the exact required heating data for the food placed by them. On the other hand, a method that automatically detects the input parameters of the food to be heated, is advantageous. This is effected by the object recognition and/or the determination device. In other words, the system can determine the input parameters of the food to be heated and/or of the cooking chamber automatically by the object recognition and/or the determination device, and/or forward it to the control unit. In this way, the user does not have to know the input parameters of the foods. In particular, a user can determine certain input parameters such as weight, density or size hardly by themselves. The object recognition of the system recognizes the foods or the input parameters of a food automatically. In this way, the object recognition can, for example, display some of the input parameters it determined on a screen of the setting device. The user may then complete missing input parameters by means of the setting device, or provide additional input parameters. For the recognition of the input parameters, the object recognition preferably uses one or more cameras and/or one or more sensors of the system. After the automatic detection of the input parameters of the food, the input parameters are forwarded by the object recognition to the control unit via a data connection. The control unit thus receives all relevant input parameters via the food positioned in the cooking chamber and subsequently establishes, in particular by reading cooking data based upon the input parameters, how the radiation characteristic has to look like to bring all foods positioned in the cooking chamber into the same cooking state and the same eating temperature at the same time.

Furthermore, a method is preferred in which, for the cooking of the outer region of the at least one food into a crusty state, at least one of the transmission antennae or at least one additional transmission antenna is actuated by a high-frequency signal transmitter of the system or by at least one additional high-frequency signal transmitter in such a way that the at least one of the transmission antennae or the at least one additional transmission antenna emits energy in the form of electromagnetic radiation in the terahertz range, in particular in a frequency range from 300 GHz to 10 THz, into the cooking chamber. As a result, the system is suitable for both cooking of the food from inside in the microwave range, i.e. in particular in a frequency range from 2 GHz to 3 GHz, for cooking, and for roasting the food from outside in the terahertz range, i.e. in the frequency range from 1 THz to 10 THz. The different foods can be brought into an optimum cooking state simultaneously or almost simultaneously, and be cooked till crispy at the same time, by such a method.

Furthermore, a method is advantageous in which at least one of the transmission antennae or in which multiple transmission antennae is/are moved in groups by actuation by the control unit, in particular two-dimensionally or three-dimensionally, and/or pivoted about an axis of rotation. As a result, the distance between transmission antennae can be changed. This has an influence on the phases of the electromagnetic waves to one another. By a displacement of the transmission antennae relative to one another, the radiation characteristic in the cooking chamber can be changed. The constructive and destructive interferences between the electromagnetic waves of the different transmission antennae are changed by the change of position of each one of the transmission antennae. The control unit can adjust the transmission antenna in such a way that a radiation optimal for the foods can be effected, in order to bring them into the same cooking state and the same eating temperature at the same time. The control unit can direct the radiation of each antenna in a concentrated manner on a certain zone in the cooking chamber and thus on a certain food by actuation of radiation funnels of the transmission antennae, if available. Each individual food can thereby be heated even more individually. By the pivotability of the radiation funnels, the orientation of the radiated electromagnetic radiation can be adjusted in accordance with the requirements.

The method according to the invention for operating a system for preparing at least one food can be conducted with a system as described above, wherein the described device features of the system can be modified into corresponding method steps or be configured as corresponding method steps.

BRIEF DESCRIPTION OF THE DRAWINGS

Further measures improving the invention result from the following description of the different exemplary embodiments of the invention, which are schematically shown in the Figures. All features and/or advantages resulting from the claims, the description or the drawings can both each per se, or in different combinations, be essential to the invention.

The Figures schematically show in.

DETAILED DESCRIPTION OF SPECIFIC EMBODIMENTS

Figure 1:
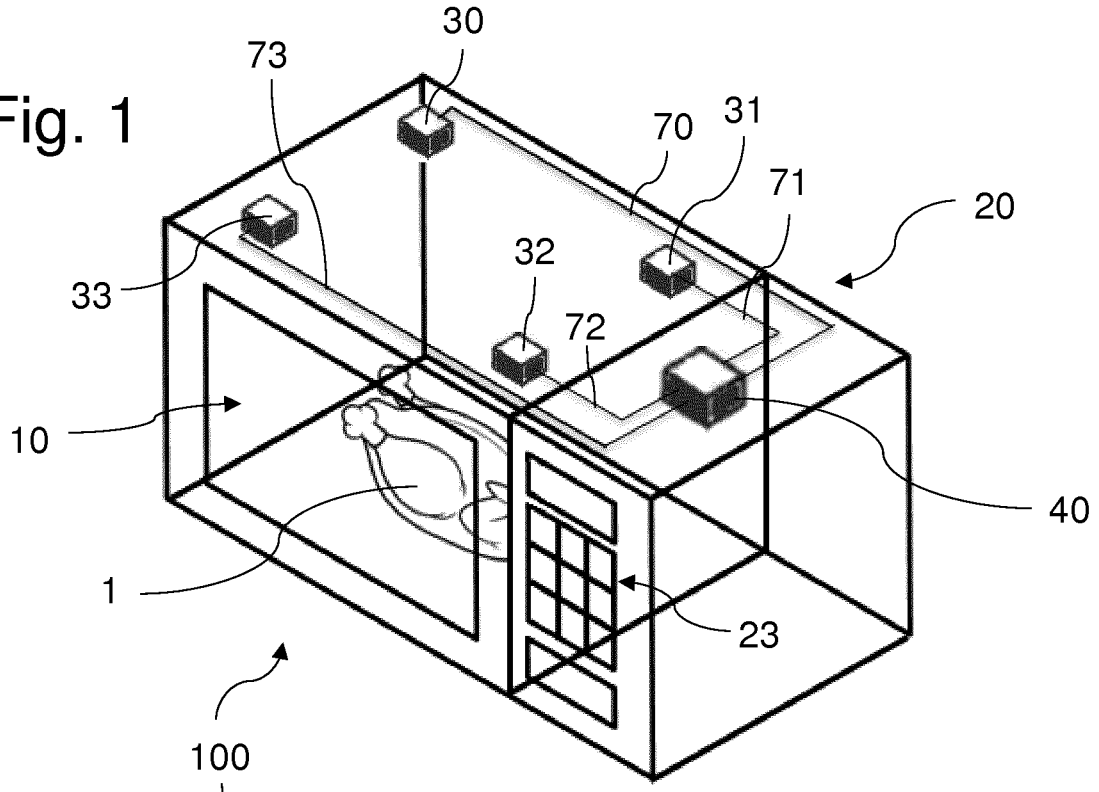
FIG. 1 a perspective view of a first embodiment of a system for the preparation of at least one food.
Figure 2:
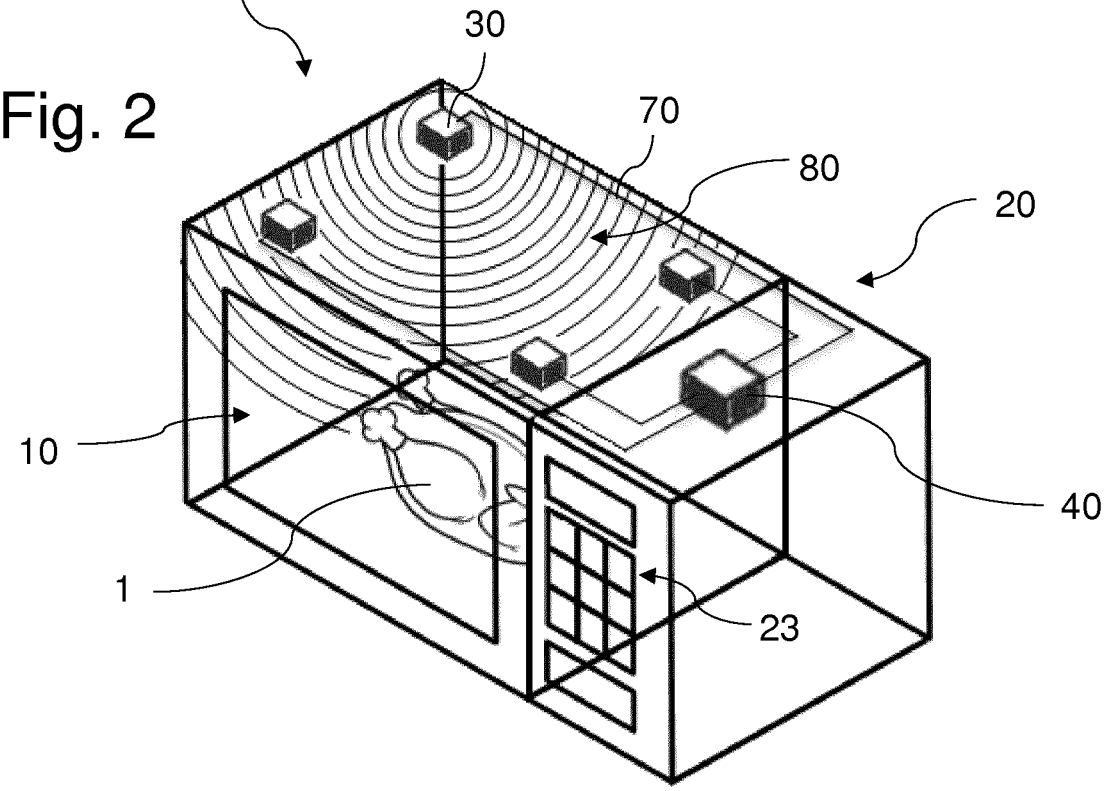
FIG. 2 the system according to FIG. 1 with an illustration of the electromagnetic radiation of a transmission antenna, FIG. 3 the system according to FIG. 1 with an illustration of electromagnetic radiation of all transmission antennae, FIG. 4 the system according to FIG. 1 with an illustration of the electromagnetic radiation of a transmission antenna by means of a radiation funnel, FIG. 5 a top view of a food carrier with different foods, FIG. 6 a perspective view of a second embodiment of a system for the preparation of at least one food, FIG. 7 the system according to claim 1 with the additional representation of power amplifiers on the transmission antennae, FIG. 8 the system of FIG. 7 with the additional illustration of a control unit of the system, FIG. 9 the cooking chamber of the system according to FIG. 1, FIG. 10 the system according to FIG. 8 with the additional illustration of a database and a data interface of the system, FIG. 11 the system according to FIG. 1 with the illustration of an additional transmission antenna and an additional high-frequency signal transmitter, FIG. 12 the cooking chamber of the system according to FIG. 1 with drives for adjusting the transmission antennae, FIG. 13 a constructive interference of the electromagnetic waves of two transmission antennae, FIG. 14 a destructive interference of the electromagnetic waves of two transmission antennae, FIG. 15 a side view of a food being radiated, FIG. 16 a side view of a system according to a third embodiment of the present invention with additional heating means, FIG. 17 a side view of a system according to a fourth embodiment of the resent invention with the illustration of a radiation hot-spot, FIG. 18 a side view of a system according to a fifth embodiment of the present invention with an object recognition, a determining device and a database, and FIG. 19 an illustration of the method for operating a system for the preparation of at least one food.

Elements having the same function and effects are indicated with the same reference characters throughout the FIGS. 1 to 19.

Figure 5:
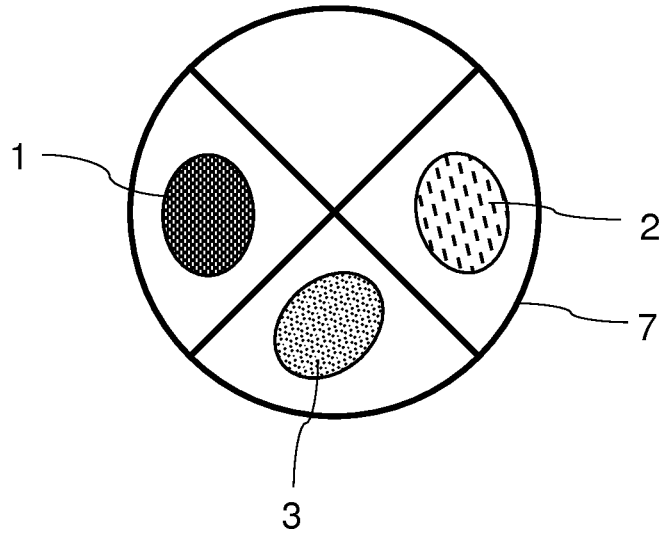

FIG. 1 schematically shows a system 100 according to the invention for preparing at least one food 1. The system 100 comprises a cooking chamber 10, in which the food 1, here in the form of chicken, can be positioned. Ideally, the one or more foods 1, 2, 3 are placed on a special metal-free food carrier 7, which is illustrated in greater detail here. The food carrier 7 preferably is a plate, which is subdivided into sections for different foods 1, 2, 3. Such a food carrier 7 is shown in FIG. 5.

The system 100 comprises an energy unit 20, which is configured to supply a supply of electromagnetic energy, specific to the at least one food 1, 2, 3, here the chicken 1, into the cooking chamber 10 dependent upon the cooking data 4, 5, 6, whereby the at least one food 1, 2, 3 can be brought into an edible state. The energy unit 20 comprises at least two spaced transmission antennae, in this case four transmission antennae 30, 31, 32, 33, which can be actuated by at least one high-frequency signal transmitter, in this case by a high-frequency signal transmitter 40 of the energy unit 20 of the system 100. The transmission antennae 30, 31, 32, 33 emit energy in the form or electromagnetic radiation 80 in the microwave range into the cooking chamber 10 based upon this actuation. The emission of electromagnetic radiation 80 is shown for one of the transmission antennae 30 in an exemplary manner. In other words, the high-frequency signal transmitter 40 transmits energy into an oscillating circuit, wherein a magnetic field is respectively generated around the conductors 70, 71, 72, 73, which is transmitted to the respective transmission antennae 30, 31, 32, 33 via the conductors 70, 71, 72, 73. The high-frequency signal transmitter 40 emits a constant signal, in particular a signal with 2.35 to 2.45 GHz, to the respective transmission antennae 30, 31, 32, 33. The high-frequency signal transmitter 40 emits high-frequent sinusoidal oscillations and provides the possibility of frequency and amplitude modulation.

Figure 6:
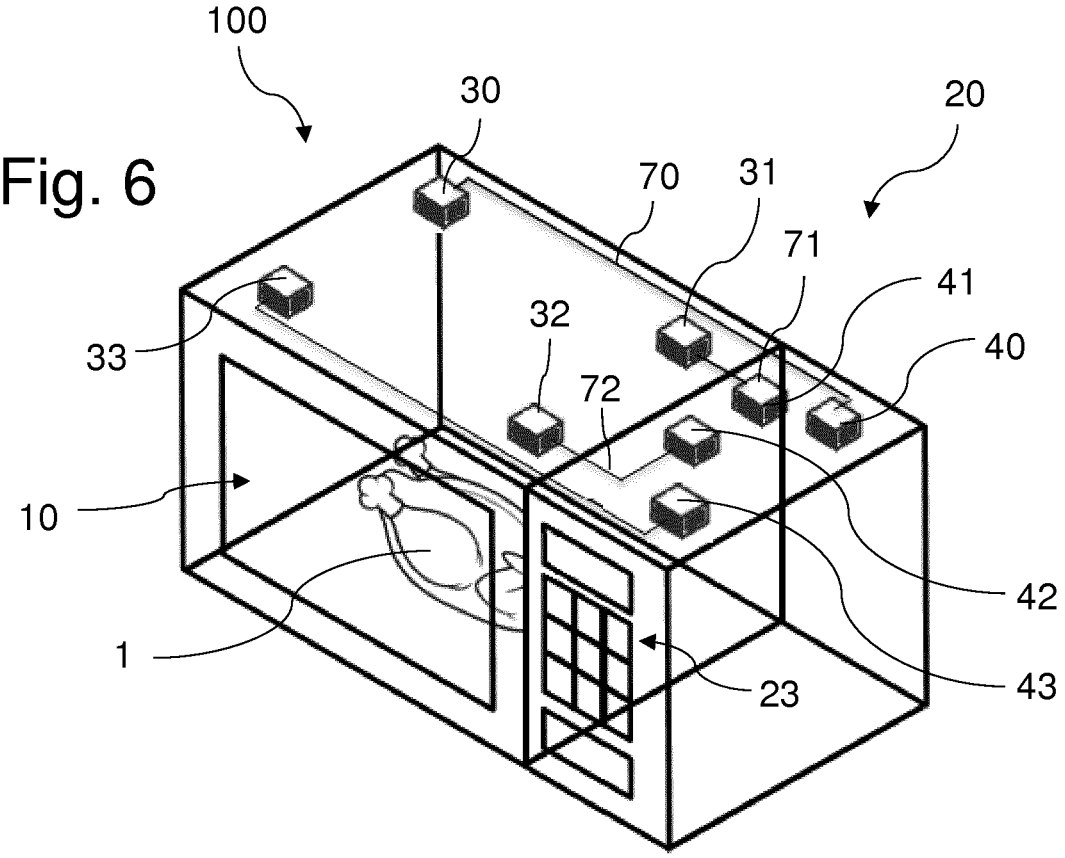

As an alternative to the system 100 according to FIG. 1, a system 100 can be advantageous, which comprises not one single high-frequency signal transmitter 40, but one separate high-frequency signal transmitter 40, 41, 42, 43 for each transmission antenna 30, 31, 32, 33. Such a system 100 is shown in FIG. 6. All of the four transmission antennae 30, 31, 32, 33 can respectively be actuated by in each case one high-frequency signal transmitter 40, 41, 42, 43 of the energy unit 20 of the system 100. In this case, each high-frequency signal transmitter 40, 41, 42, 43 transmits energy into an oscillating circuit, wherein the respective conductor 70, 71, 72, 73 establishes a magnetic field. The transmission antennae 30, 31, 32, 33 emit energy in the form of electromagnetic waves with a certain frequency in the microwave range into the cooking chamber 10. Preferably, each high-frequency signal transmitter 40, 41, 42, 43 is configured to emit a constant signal, in particular a signal with 2.35 GHz to 2.45 GHz. The high-frequency signal transmitters 40, 41, 42, 43 emit high-frequent sinusoidal oscillations. The high-frequency signal transmitters 40, 41, 42, 43 all offer the possibility of frequency and amplitude modulation. As a result, the phase shifts and thus the interferences between electromagnetic waves can be reached in a targeted manner.

The system 100 is preferably configured as a cooking device and comprises a setting device 23, in particular a touchscreen, for entering input parameters of the at least one food 1, 2, 3 or of the cooking chamber 10. Furthermore, the user of the system 100 can see information on the system 100, the heating process and/or the input parameters of each food 1, 2, 3.

Figure 3:
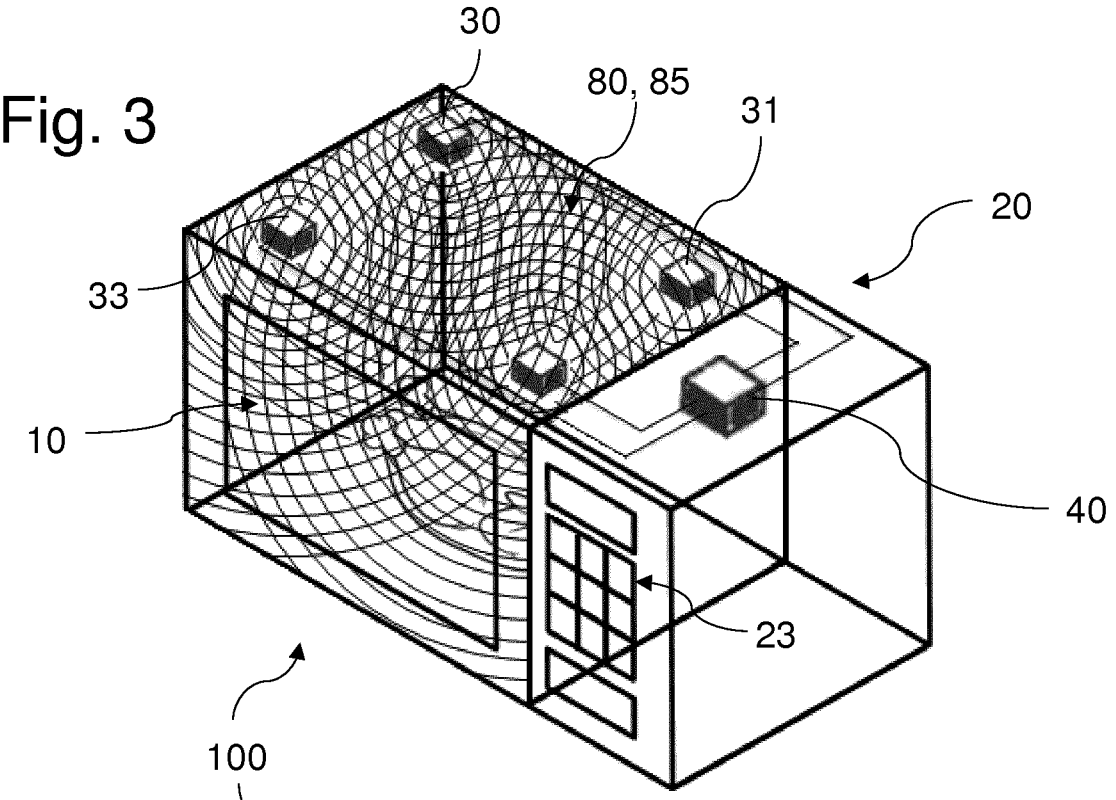

FIG. 3 schematically shows the system 100 according to FIG. 1 with an illustration of the electromagnetic radiation 80 of all four transmission antennae 30, 31, 32, 33. The electromagnetic waves of the individual transmission antennae 30, 31, 32, 33 interfere in the cooking chamber 10, whereby the formation of different radiation zones 85 within the cooking chamber 10 results. This results in constructive and destructive interferences between electromagnetic waves of the transmission antennae 30, 31, 32, 33. In other words, by the superposition of the electromagnetic waves in the cooking chamber 100, the electromagnetic radiation 80 can be intensified in some regions, while being weaker in other regions. Thus, radiations zones 85 with different radiation intensity can be created inside the cooking chamber 10. In so-called hot-spots 86, the electromagnetic radiation 80 and thus the temperature level is high, while in other radiation zones 85, a lower electromagnetic radiation 80 and a lower temperature level prevail.

The electromagnetic waves of the individual transmission antennae 30, 31, 32, 33 running to the walls of the cooking chamber 10 are reflected up to 800 times there and, in turn, form interferences. However, this is not shown in the Figures.

Figure 4:
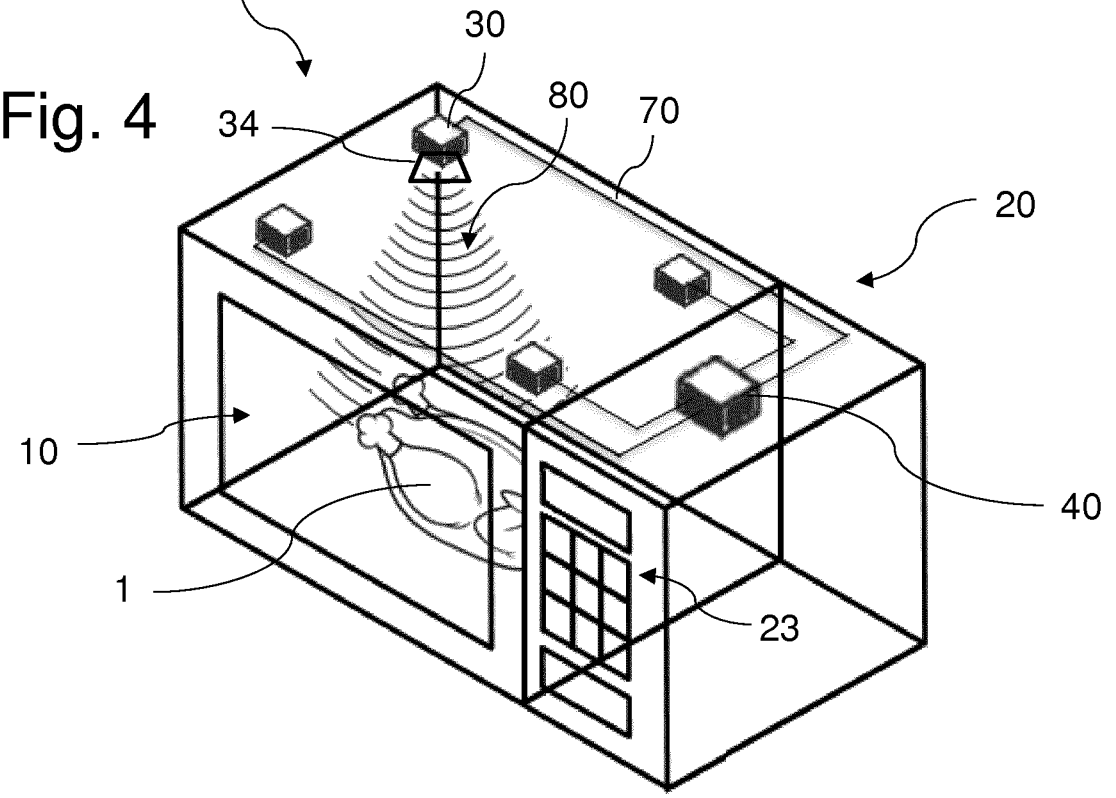

FIG. 4 schematically shows the system 100 according to FIG. 1, wherein the electromagnetic radiation 80 of a transmission antenna 30 is directed by means of a radiation funnel 34. Preferably all transmission antennae 30, 31, 32, 33 comprise a distinct radiation funnel 34 for the directed emission of the electromagnetic radiation. By means of the radiation funnel 34, the emission of the electromagnetic radiation 80 of the transmission antenna 30 can be controlled. In particular, the radiated electromagnetic radiation 80 can be directed to a certain region inside the cooking chamber 10 and thus to the selected food 1. Thus, each individual food 1, 2, 3 can be heated even more individually. By the pivotability of the radiation funnel 34, the orientation of the emitted electromagnetic radiation 80 can be adjusted according to the requirements.

FIG. 5 schematically shows, in a plan view, a food carrier 7 with different foods 1, 2 3. The food carrier 7 is preferably sub-divided into defined sections. In this example, the food carrier 7 is subdivided into four regions of the same size. Advantageously, the food carrier 7 can be oriented only in a very special orientation in the cooking chamber 10, so that the arrangement of the food carrier 7 is adapted to the arrangement of the transmission antennae 30, 31, 32, 33. The foods 1, 2, 3 have different properties such as type, size, weight and density. Thus, they require a different electromagnetic radiation in the cooking chamber 10, in order to be brought into the same cooking state and the same eating temperature. This can occur through the system 100.

Figure 7:
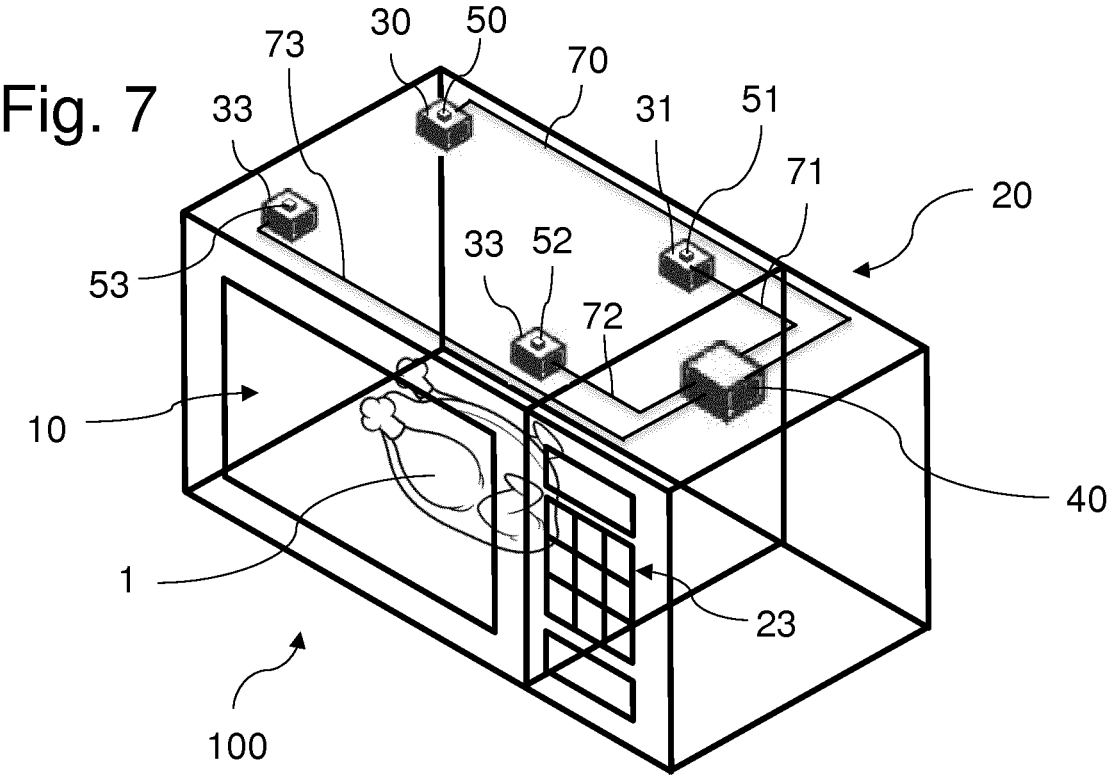

FIG. 7 schematically shows, in a perspective view, the system 100 in accordance with FIG. 1 with an additional illustration of power amplifiers 50, 51, 52, 53 on the transmission antennae 30, 31, 32, 33. In other words, each transmission antennae 30, 31, 32, 33 is operatively assigned one power amplifier 50, 51, 52, 53 for the amplification of the electromagnetic radiation 80 of the respective transmission antennae 30, 31, 32 33. The power amplifiers 50, 51, 52, 53 enable to output the modulated input high-frequency signal at the transmission antenna output in an amplified manner without power losses. The power amplifiers 50, 51, 52, 53 can be formed as non-linear or linear power amplifiers. In particular, the power amplifiers 50, 51, 52, 53 can be formed in such a way that a control, in particular an amplification, of the emitted power is enabled by them.

Figure 8:
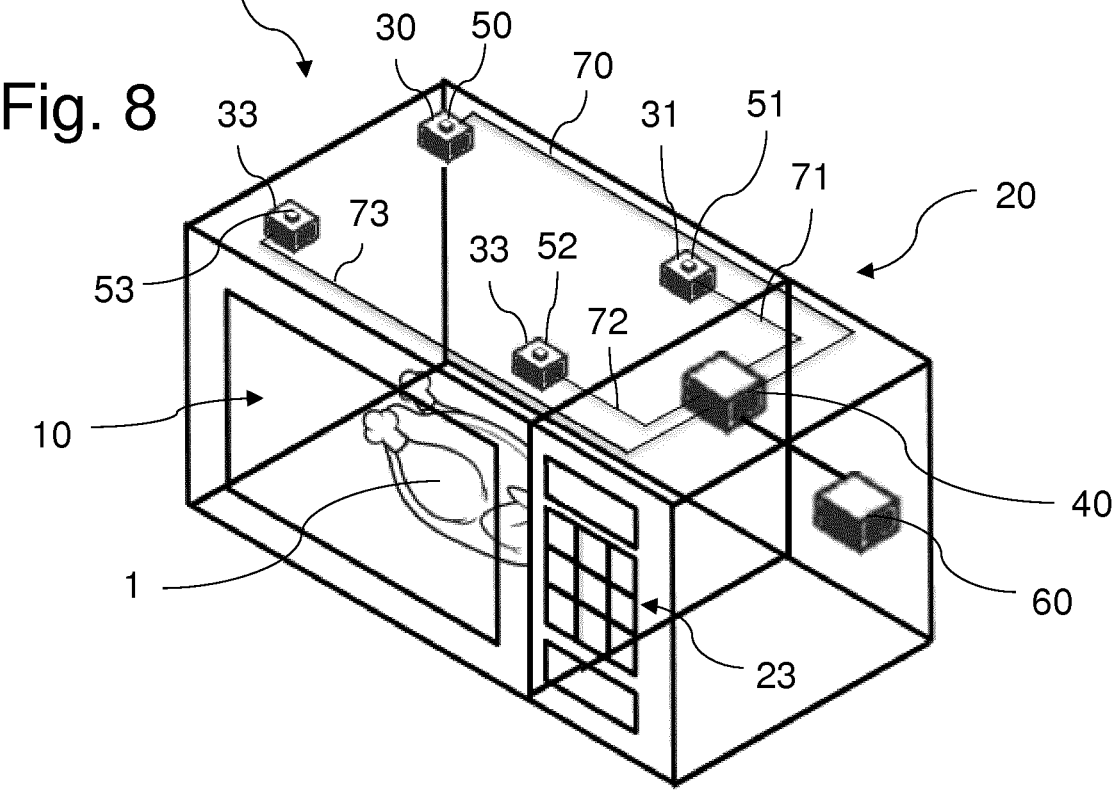

FIG. 8 schematically shows, in a perspective view, the system 100 in accordance with FIG. 7 with an additional representation of a control unit 60 of the system 100. The control unit 60 controls the actuation of each transmission antenna 30, 31, 32, 33 by the at least one high-frequency signal transmitter 40, 41, 42, 43. However, likewise two or more control units 60 can be provided. Particularly preferably, each transmission antenna 30, 31, 32, 33 is connected to an associated high-frequency signal transmitter 40, 41, 42, 43. The control unit 60 can actuate each individual high-frequency signal transmitter 40, 41, 42, 43, i.e. turn it on or off. As a result, the control unit 60 determines the time periods that a transmission antenna 30, 31, 32, 33 emit electromagnetic radiation 80 or not. Depending on the requirements, the control unit 60 can also directly actuate the transmission antennae 30, 31, 32, 33 and turn them on or off correspondingly. In particular, the radiation period of each transmission antennae 30, 31, 32, 33 can be controlled by the at least one control unit 60. The control unit 60 enables to supply electromagnetic radiation 80 specific to the at least one food 1, 2, 3 into the cooking chamber 10 dependent upon the cooking data 4, 5, 6 of the at least one food 1, 2, 3. In other words, the control unit 60 influences or controls the radiation zones 85 or temperature zones inside the cooking chamber 10, in that it ensures if and which transmission antenna 30, 31, 32, 33 emits electromagnetic radiation and when. The system 100 can thereby assign a radiation specific to each food 1, 2, 3 into the cooking chamber 10 in the knowledge of the exact position of the individual foods 1, 2, 3, so that all foods 1, 2, 3 positioned in the cooking chamber 10 reach their cooking state and the same eating temperature at the same time. The control unit 60 is connected to the high-frequency signal transmitters 40, 41, 42, 43 and/or the transmission antennae 30, 31, 32, 33 in a wired or wireless manner for the actuation of the high-frequency signal transmitters 40, 41, 42, 43 and/or the transmission antenna 30, 31, 32, 33.

Figure 9:
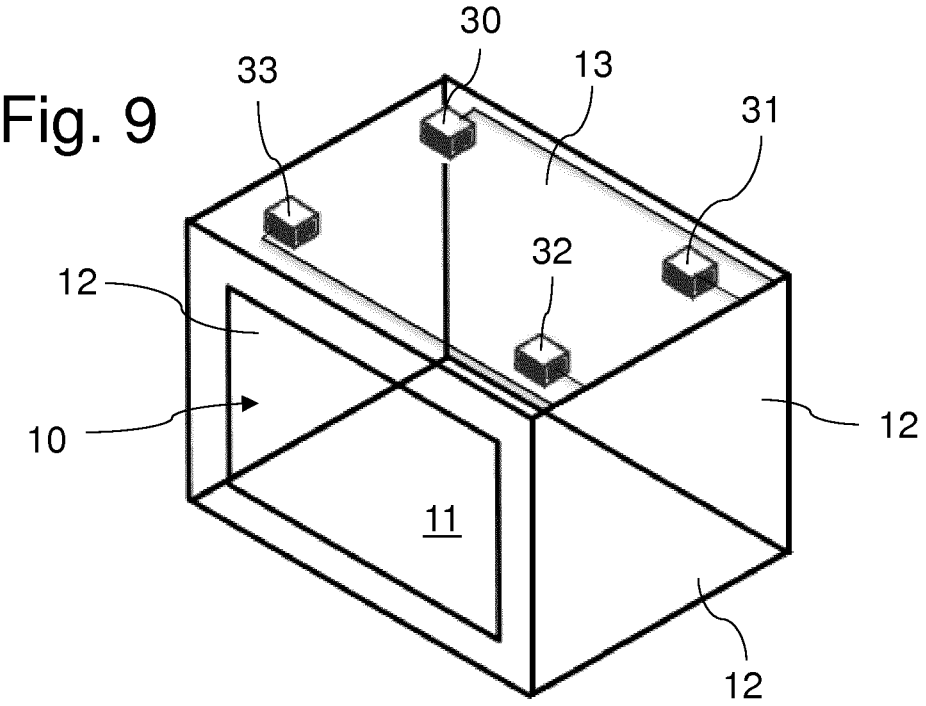
Figure 10:
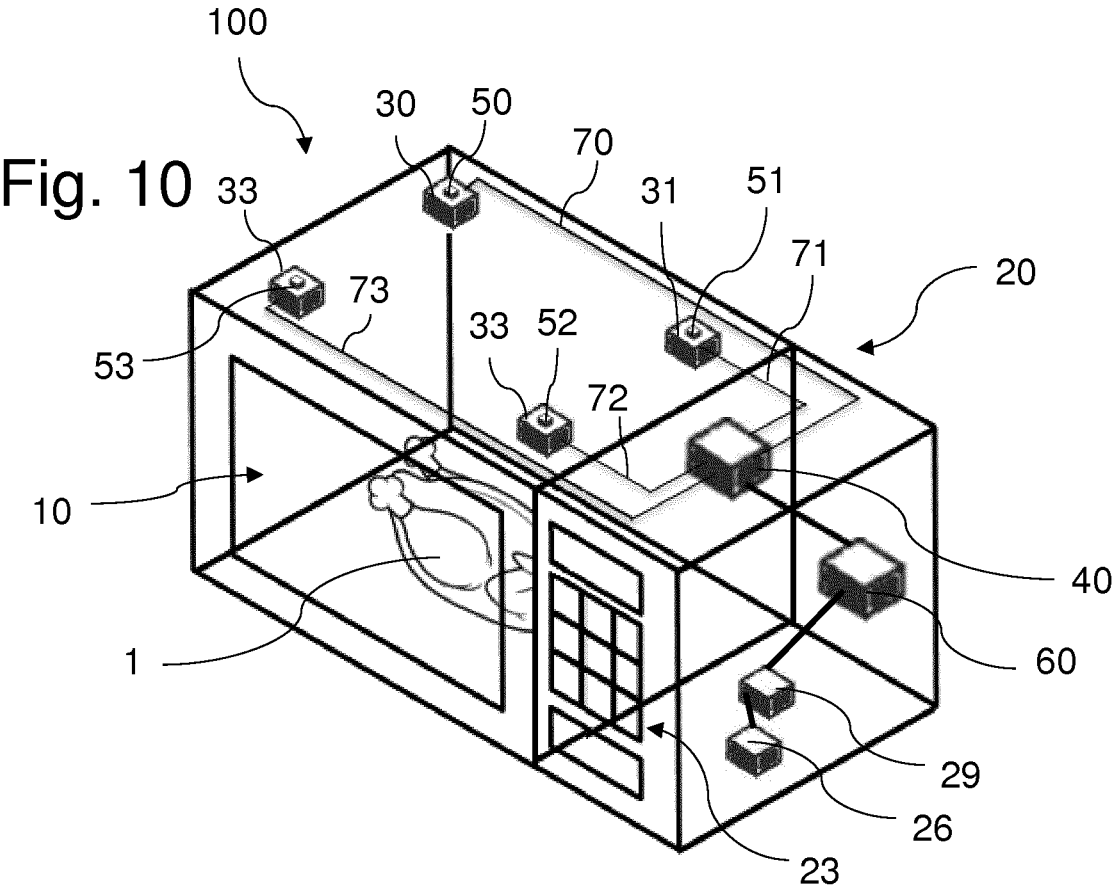
Figure 11:
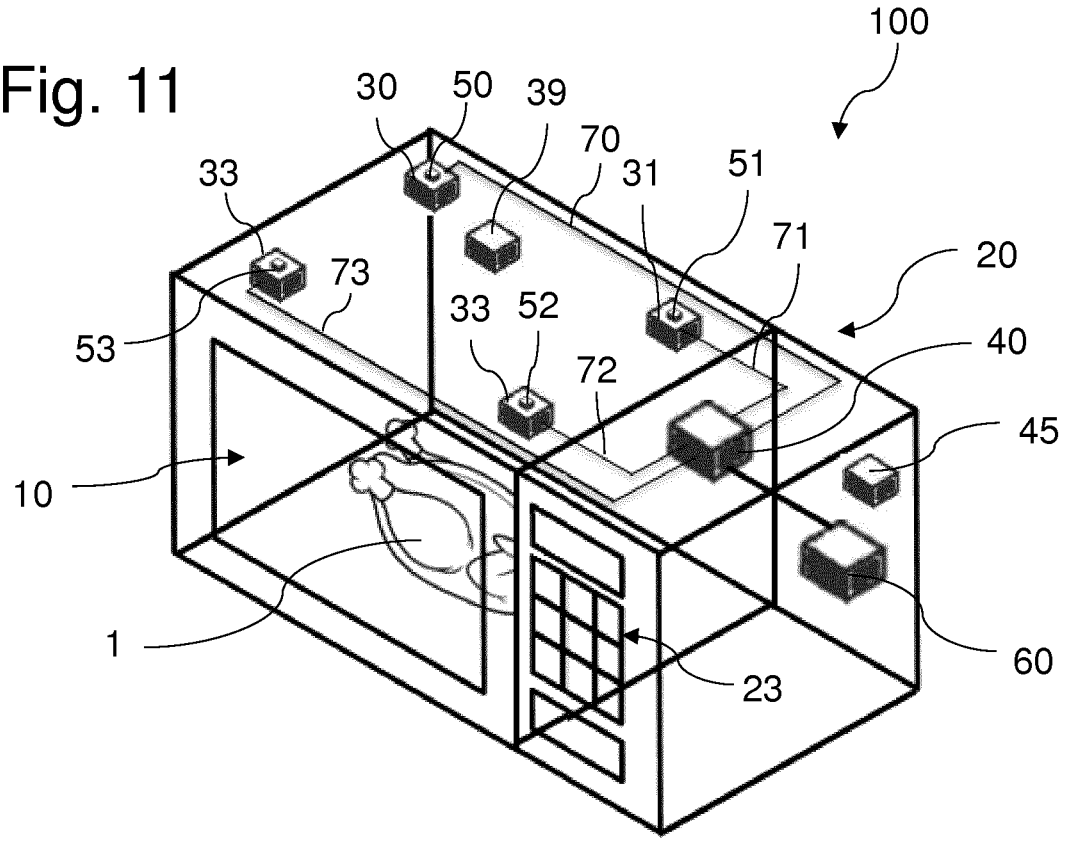
Figure 12:
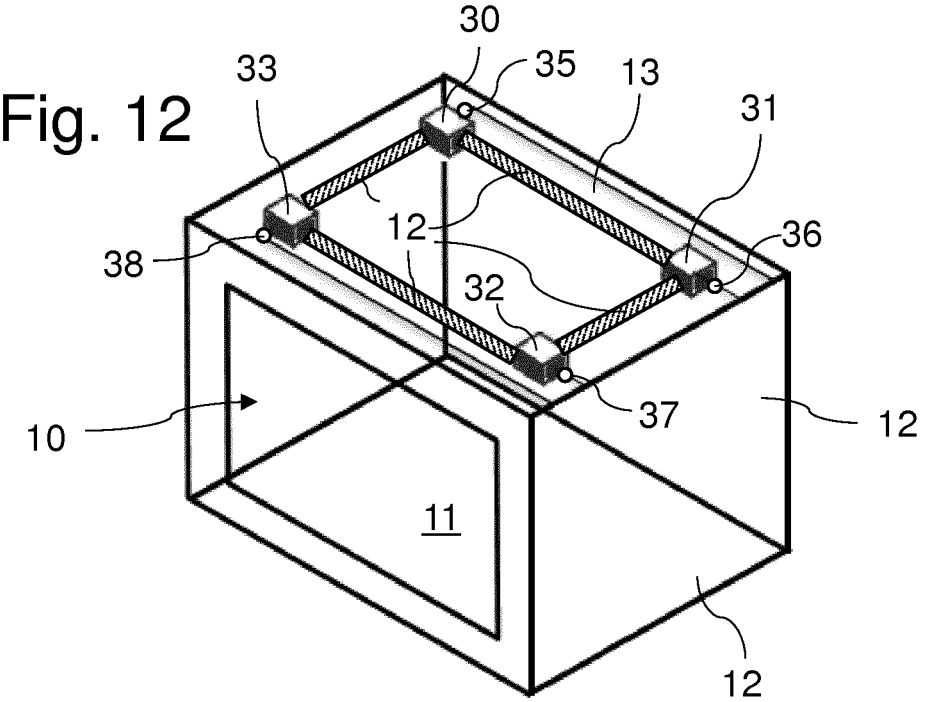

FIG. 9 schematically shows, in a perspective view, the cooking chamber 10 of the system 100 according to FIG. 1. The cooking chamber 10 is hermetically sealed while the electromagnetic radiation is performed, and thus forms a closed structure. The cooking chamber 10 therefore comprises a housing, in particular a cuboid housing. The housing comprises a bottom 11, side walls 12 and a ceiling 13. For the access to the cooking chamber 100, a not further illustrated door is provided. The door is preferably arranged to be pivotable on the housing. The transmission antennae 30, 31, 32, 33 can be arranged in a distributed manner all over the cooking chamber 10, in particular on the housing of the cooking chamber 10. Thus, transmission antennae 30, 31, 32, 33 can be mounted on the side walls 12, on the bottom 11 and on the ceiling 13. The more distributed the transmission antennae 30, 31, 32, 33 are arranged, the better the food 1, 2, 3 can be radiated from all sides by the electromagnetic radiation 80. The housing can comprise an extension to the limitation of the cooking chamber 10, in which other elements of the system are arranged, in particular enclosed. Also the high-frequency signal transmitters 40, 41, 42, 43 and the power amplifiers 50, 51, 52, 53 can be mounted on the housing. The transmission antennae are however, preferably arranged on the ceiling 30, 31, 32, 33 of the housing. As a result, they are arranged in a most protected manner and are only slightly subjected to dirt. However, alternatively or additionally, they can be arranged on the side walls 12 or on the bottom 11. The same applies to the high-frequency signal transmitters 40, 41, 42, 43 and to the power amplifiers 50, 51, 52, 53.

FIG. 8 schematically shows the system according to FIG. 8 with the additional representation of a database 29 and a data interface 26 of the system 100. The database 29 is coupled to the at least one control unit 60 in a data-communicating manner, such that the control unit 60 can read-out cooking data 4, 5, 6 based on input parameters of the at least one food 1, 2, 3. The database 29 can include a storage device, in which input parameters of foods 1, 2, 3 can be stored for comparison. The system 100, in particular the database 29, can further comprise a data interface 26, in particular in the form of a communication device, for obtaining food-specific data and input parameters via the internet or another wired or wireless network. Via the database 29, the control unit 60 can determine cooking data 4, 5, 6 of the respective foods 1, 2, 3 in order to carry out a respective actuation of the energy unit 20 based on the cooking data 4, 5, 6, i.e. of the high-frequency signal transmitter 40, 41, 42, 43 and/or of the transmission antennae 30, 31, 32, 33, in order to establish the required electromagnetic radiation by the transmission antennae 30, 31, 32, 33 individually for each food 1, 2, 3. The system 100 can furthermore include a comparing device (not illustrated in greater detail here), which is connected to the control unit 60 in a data-technical manner, wired or wireless. In this way, the control unit 60 can compare entered input parameters with comparison parameters from the database 29, in order to determine the exact cooking data 4, 5, 6 for each food product 1, 2, 3.

Figure 13:
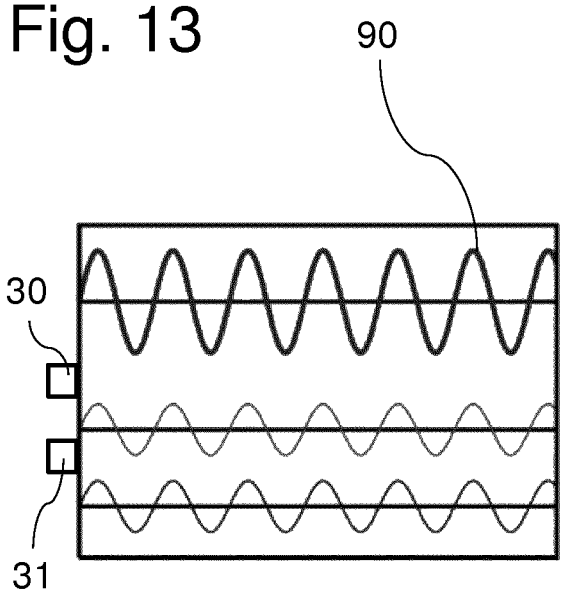
Figure 14:
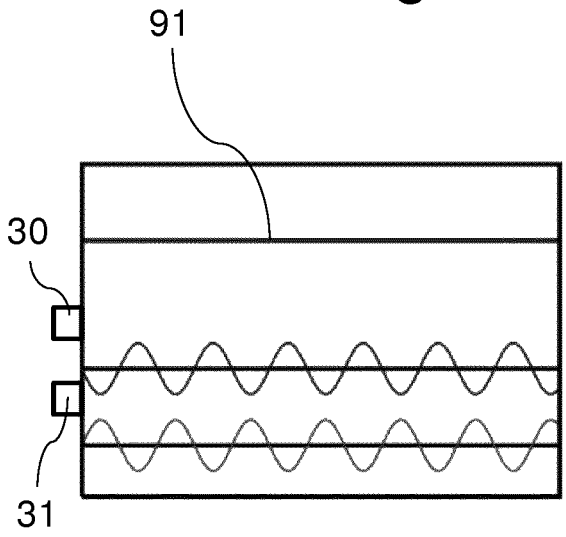
Figure 15:
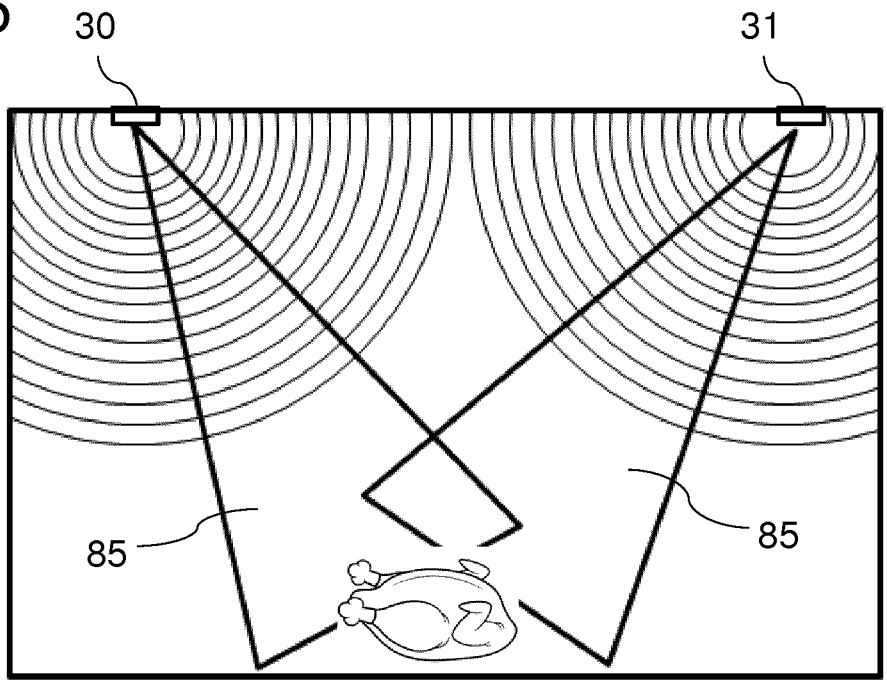

FIGS. 13 and 14 show a constructive interference, respectively a constructive interference of electromagnetic waves of two transmission antennae 30, 31 of a system 100. The control unit 60 can control the emission characteristics of each transmission antennae 30, 31, 32, 33 in such a way, that either constructive interferences or destructive interferences of electromagnetic radiation 80 or of waves, respectively, result in areas inside the cooking chamber 10. I.e., the control unit defines, by targeted actuation of the transmission antennae 30, 31, 32, 33 and/or of the high-frequency signal transmitters 40, 41, 42, 43, where in the cooking chamber 10 the electromagnetic radiations 80 are amplified by means of interferences, and where they are weakened. FIG. 15 schematically illustrates how the electromagnetic waves propagate inside the cooking chamber 10 towards the food 1. In this way, so-called hotspots 86 can be generated, see FIG. 17. A constant temperature level prevails in the hotspots 86, in order to more intensively heat foods 1, 2, 3 which heat-up slower due to their type, size and weight and therefore their density. Accordingly, radiation zones or temperature zones, respectively, can be created, in which a lower or an average temperature level prevails, in order to more slowly heat food products 1, 2, 3, which heat-up fast due to their type, size and weight. By a targeted combination of the various transmission antennae 30, 31, 32, 33, i.e. by a targeted turn-on or turn-off of the individual transmission antennae 30, 31, 32, 33 or, if the case may be, of the high-frequency signal generators, 40, 41, 42, 43, it is possible, based upon the superposition principle by constructive and destructive interferences, to generate various radiation zones 85 and therefore temperature zones inside the cooking chamber 10. As a result, the temperature distribution inside the cooking chamber 10 can be controlled by means of the at least one control unit 60, according to the requirements.

Figure 16:
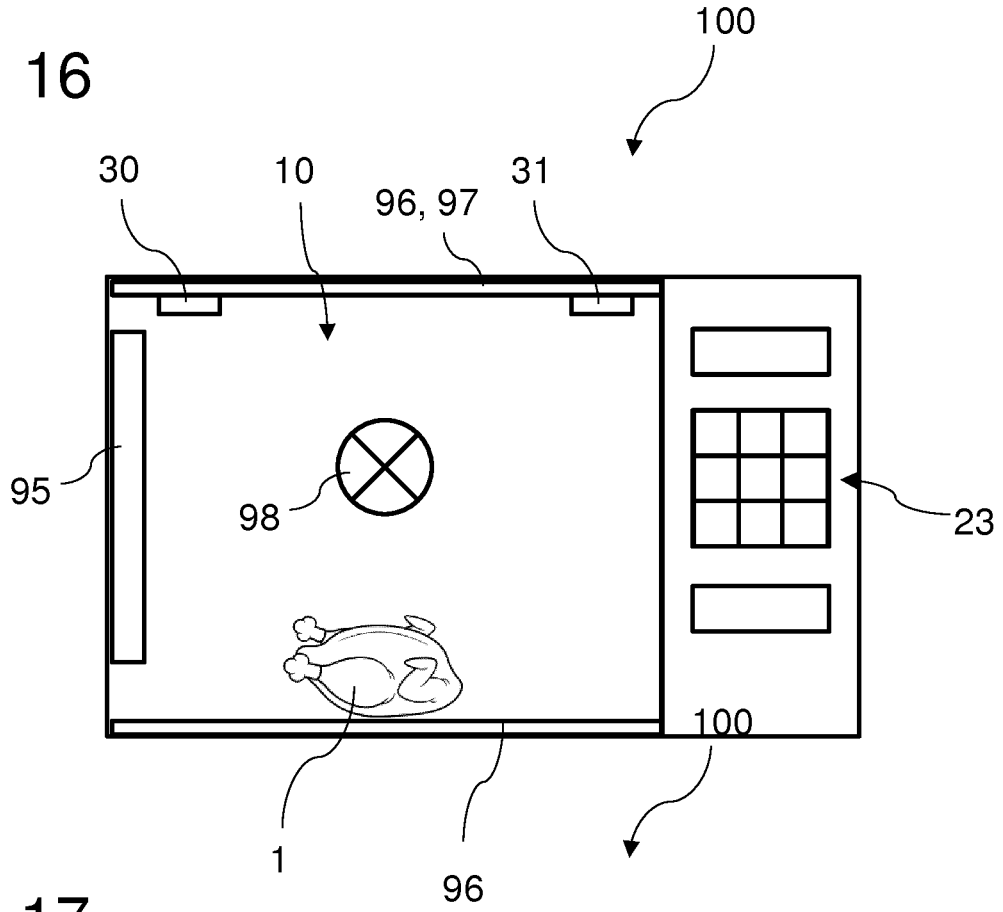
Figure 17:
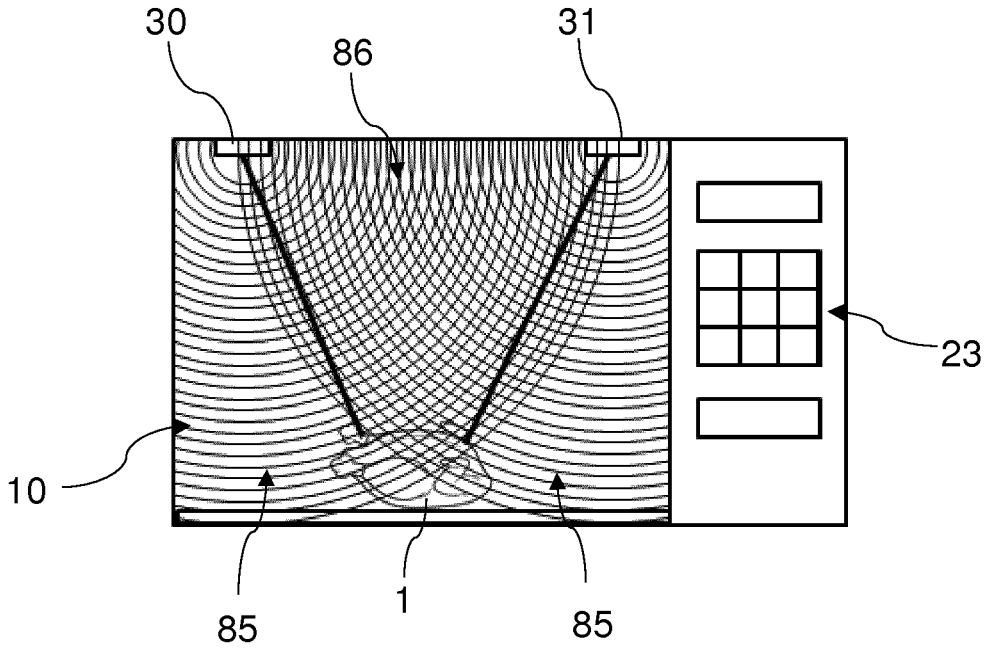

FIG. 16 schematically shows, in a side view, a system 100 according to a third embodiment of the present invention. In this system 100 for the preparation of at least one food 1, 2, 3, additional heating means are provided for heating the foods 1, 2, 3. Due to the electromagnetic radiation 80 of the food 1, 2, 3, these foods can be brought into a cooking state. In order to heat both the inside of a product to be cooked, i.e. of the foods 1, 2, 3 as well as to roast the outside of a product to be cooked till crispy, different frequency ranges are required, or different heating elements/heating means are required. In a system 100 according to FIG. 16, this is achieved in that additionally a grill 95 and/or heating coils 95 for generating top/bottom heat and/or a heat source 97 with a fan 98 is provided. Of course, systems 100 which only comprise one or two of these additional heating elements/heating means 95, 96, 97, 98 are also advantageous.

Figure 18:
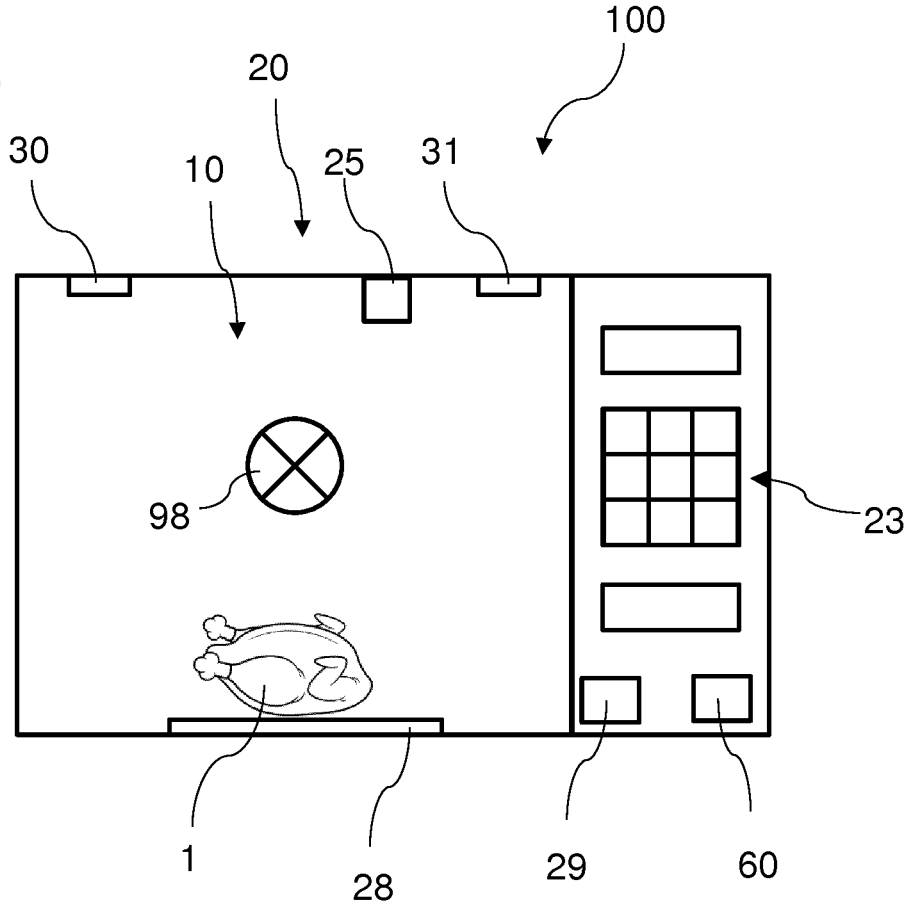

FIG. 18 schematically shows, in a side view, a system 100 according to a fifth embodiment of the present invention. In this embodiment, the system 100 comprises an object recognition 25, a determination device 28 and a database 29. The object recognition is configured for automatically determining at least one of the following parameters of the at least one food 1, 2, 3 as the input parameters for the control unit 60: size, density, quantity, position of the food 1, 2, 3 in the cooking chamber. Furthermore, the object recognition 25 is coupled to the control unit 60 in a data-communicating manner in order to transmit the automatically-determined input parameters to the control unit 60. In this way, the control unit 60 can obtain all relevant input parameters about the food 1, 2, 3 positioned inside the cooking chamber 10, by means of which parameters the control unit 60 can establish how the radiation characteristic has to look like during the later-preformed heating in the cooking chamber 10, in order to ensure that all foods 1, 2, 3 positioned in the cooking chamber 10 reach their cooking state and have the same eating temperature at the same time.

The user must input no or only few input parameters into the system 100 via the setting device 23. The object recognition 25 itself determines at least some of the input parameters of a food 1, 2, 3. This simplifies the input of the input parameters significantly simpler for the user. Preferably, the object recognition 25 is coupled to the setting device 23 in a data-communicating manner. In this way, the system 100 can display some of the input parameters determined by the object recognition 25 to the user, on a screen of the setting device 23. The user adds the missing input parameters or enters additional input parameters. In particular the recognition of the position of the individual foods 1, 2, 3 inside the cooking chamber 10 is a huge help for the user.

The object recognition 25 comprises at least one camera. Alternatively or in addition to the at least one camera, the object recognition can comprise one or more sensors, which can recognize the position or the size of a food 1, 2, 3, for example.

The system 100 according to FIG. 18 further comprises a determination device 28 for determining the weight of the at least one food 1, 2, 3. The determination device 28 is coupled to the at least one control unit 60 in a data-communicating manner, in order to transmit the determined weight of the at least one food 1, 2, 3. The control unit 60, in turn, is configured to automatically generate different radiation zones 85 and radiation periods, adapted to the at least one food 1, 2, 3, inside the cooking chamber 10 by means of the transmission antennae 30, 31, 32, 33, based upon the transmitted input parameters of the at least one food 1, 2, 3. Depending on the system 100, the determination device 28 can be arranged differently. Therefore, the determination device 28 can be placed outside the cooking chamber 10, but likewise inside the cooking chamber 10. In particular, the determination device 28 can, as represented, be arranged in the lower region of the cooking chamber 10, in order to determine the weight of the food 1, 2, 3, directly after the positioning thereof inside the cooking chamber 10. The determination device 28 is preferably a weighing device. The determination device 28 can be sub-divided into segments, in order to be able to determine the weight of individual foods 1, 2, 3, preferably selectively or one after the other, with a correspondingly formed food carrier 7.

Figure 19:
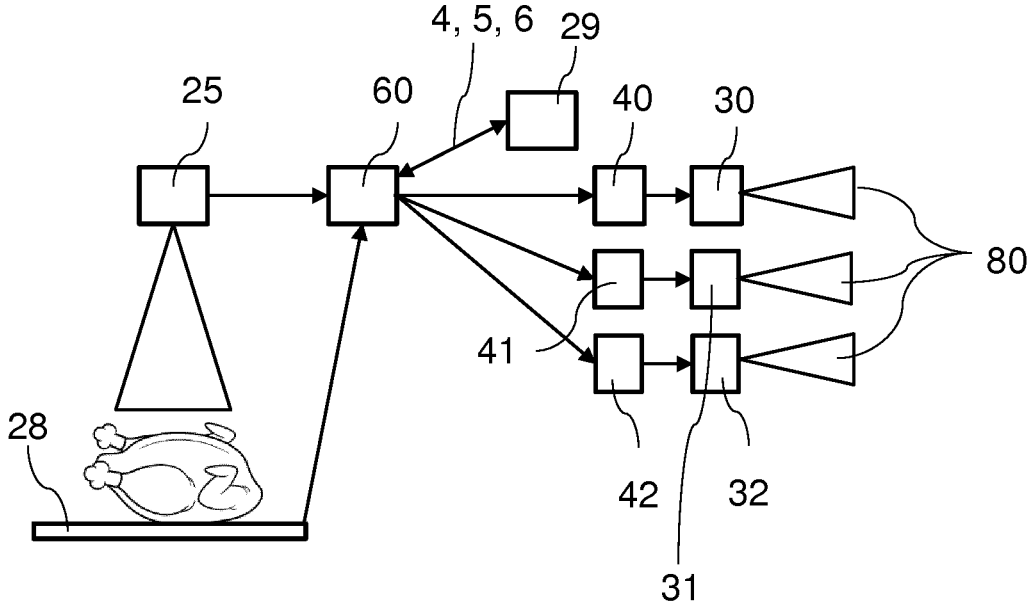

FIG. 19 schematically shows a representation of the method for operating a system for the reparation of at least one food 1, 2, 3. First, input parameters of the at least one food 1, 2, 3 are determined by the determination device 28 and/or by the object recognition 25. After that, the determined input parameters are forwarded to the at least one control unit 60. This unit can, based upon the input parameters of the at least one food 1, 2, 3, read-out cooking data 4, 5, 6 from a database 29 of the system 100. The database 29 can also be part of a network, a computer on the internet, which can be accessed by the control unit 60. Based on the cooking data 4, 5, 6, the control unit 60 actuates the control unit 20, i.e. the at least one high-frequency signal transmitter 40, 41, 42, 43 and/or the transmission antennae 30, 31, 32, 33 in order to provide the required electromagnetic radiation 80 individually for each food 1, 2, 3 by means of the transmission antennae 30, 31, 32, 33. In addition, the control unit 60 can control power amplifiers 50, 51, 52, 53 of the transmission antennae 30, 31, 32, 33, if provided, in order to amplify the amplitude of the signal transmitted to the transmission antennae 30, 31, 32, 33, and thereby to influence or change the characteristic of the radiated electromagnetic radiation 80, or of the electromagnetic waves.

LIST OF REFERENCE CHARACTERS

1 First food
2 Second food
3 Third food
4 Cooking data of the first food
5 Cooking data of the second food
6 Cooking data of the third food
7 Food carrier
10 Cooking chamber
11 Bottom
12 Side walls

13 Ceiling
20 Energy unit
23 Setting device
25 Object recognition
26 Data interface
28 Determination device
29 Database
30 Transmission antenna
31 Transmission antenna
32 Transmission antenna
33 Transmission antenna
34 Radiation funnel
35 Drive
36 Drive
37 Drive
38 Drive
39 Additional Transmission antenna
40 High-frequency signal transmitter
41 High-frequency signal transmitter
42 High-frequency signal transmitter
43 High-frequency signal transmitter
45 Additional high-frequency signal transmitter
50 Power amplifier
51 Power amplifier
52 Power amplifier
53 Power amplifier
60 Control unit
70 Conductor
71 Conductor
72 Conductor
73 Conductor
80 Electromagnetic radiation
85 Radiation zones/temperature zones
86 Hot-spot
90 Constructive interference
91 Destructive interference
95 Grill
96 Heating coils
97 Heat source
98 Fan
100 System

The invention claimed is:

1. A system for preparing at least one food, comprising:
a cooking chamber in which the food can be prepared,
an energy unit to carry out a supply of electromagnetic energy, specific to the at least one food, into the cooking chamber dependent upon cooking data of the at least one food, whereby the at least one food can be brought into an edible state,
wherein
the energy unit comprises at least two transmission antennae, spaced from one another, which can be actuated by at least one high-frequency signal transmitter of the energy unit of the system, and which are configured to output energy in the form of electromagnetic radiation in the microwave range into the cooking chamber based upon this actuation,
and wherein at least one transmission antenna or each transmission antenna of the at least two transmission antennae or the at least one high-frequency signal transmitter are actuated by the control unit in such a way that constructive interferences or destructive interferences of the electromagnetic radiations, which are emitted by the at least two transmission antennae, predetermined for the formation of radiation zones or temperature zones in the cooking chamber, are generated in the cooking chamber.

2. The system according to claim 1, wherein
at least one of the transmission antennae or each transmission antenna is operatively assigned to a power amplifier for amplifying the electromagnetic radiation of the respective transmission antenna.

3. The system according to claim 1, wherein
the system comprises at least one control unit, which controls the actuation of each transmission antenna by the at least one high-frequency signal transmitter.

4. The system according to claim 3, wherein
at least the control unit is configured to turn-on and -off at least one transmission antenna or each transmission antenna, individually or as a group, for the control of the emission of the electromagnetic radiation, or wherein the control unit is configured to turn-on and -off at least one high-frequency signal transmitter of the system for the emission of signals to the at least one transmission antenna.

5. The system according to claim 1, wherein
at least one transmission antenna or multiple transmission antennae are movable in the system relative to the cooking chamber, individually or in groups, by means of one or multiple drives.

6. The system according to claim 3, wherein
the system comprises a setting device to enter input parameters of the at least one food or of the cooking chamber,
in that the setting device is coupled to the control unit in a data-communicating manner for the transmission of the entered input parameters to the control unit, and in that the control unit is configured to generate different radiation zones and radiation periods, adapted to the at least one food, inside the cooking chamber by means of the transmission antennae based upon the transmitted input parameters of the at least one food.

7. The system according to claim 6, wherein
at least the setting device is configured for the setting of at least one of the following parameters of the at least one food as an input parameter for the control unit:
type
size
weight
density
quantity
position in the cooking chamber
target temperature,
or wherein the setting device is configured for the setting of the input of the electromagnetic radiation for different radiation zones or temperature zones inside the cooking chamber.

8. The system according to claim 3, wherein
the system comprises an object recognition for the automatic determination of at least one of the following parameters of the at least one food as an input parameter for the control unit:
size
density
quantity
position in the cooking chamber,
that the object recognition is coupled to the control unit in a data-communicating manner for the transmission of the automatically determined input parameters to the control unit, and
that the control unit is configured to generate different radiation zones and radiation periods inside the cooking chamber, adapted to the at least one food, by means of the transmission antennae based upon the transmitted input parameters of the at least one food.

9. The system according to claim 3, wherein the system comprises a determination device for determining the weight of the at least one food, the determination device is coupled to the control unit in a data-communicating manner for the transmission of the determined weight of the at least one food, and that the control unit is configured to automatically generate different radiation zones and radiation periods inside the cooking chamber, adapted to the weight of the at least one food, by means of the transmission antennae based upon the transmitted weight of the at least one food.

10. The system according to claim 3, wherein the system comprises a database which is coupled to the control unit in a data-communicating manner, and from which cooking data can be read by the control unit based upon the input parameters of the at least one food.

11. The system according to claim 1, wherein the system is a cooking device, which comprises at least the cooking chamber or the energy unit or the object recognition or the setting device or the determination device.

12. The system according to claim 1, wherein at least one of the transmission antennae of the energy unit or at least one additional transmission antenna of the energy unit, which can be actuated by at least one high-frequency signal transmitter of the system or by at least one additional high-frequency signal transmitter of the system, is configured to output energy in the form of electromagnetic radiation in the terahertz range into the cooking chamber.

13. The system according to claim 3, wherein at least one of the transmission antennae comprises a radiation funnel for the directed emission of the electromagnetic radiation, that said at least one transmission antenna is mounted to be pivotable around an axis of rotation, and that said at least one transmission antennae is coupled to the control unit in a data-communicating manner for actuation by the control unit.

14. The system according to claim 1, wherein the system additionally comprises at least a grill or heating coils for generating at least top heat or bottom heat, or a heat source with a fan.

15. A method for operating a system for preparing at least one food according to claim 1, the method comprising the steps of:

at least one food is positioned in the cooking chamber of the system, the at least two spaced transmission antennae are actuated by the at least one high-frequency signal transmitter, based upon the actuation by the at least one high-frequency signal transmitter, the transmission antennae emit energy in the form of electromagnetic radiation into the cooking chamber of the system, wherein the actuation of the at least one high-frequency signal transmitter or of the at least two transmission antennae occurs dependent upon cooking data of the at least one food, whereby the at least one food is brought into an edible state, and wherein at least one transmission antenna or each transmission antenna of the at least two transmission antennae or the at least one high-frequency signal transmitter are actuated by the control unit in such a way that constructive interferences or destructive interferences of the electromagnetic radiations, which are emitted by the at least two transmission antennae, predetermined for the formation of radiation zones or temperature zones in the cooking chamber, are generated in the cooking chamber.

16. The method according to claim 15, wherein depending on the requirements for the energy to be supplied to the at least one food, the power amplifier of the at least one transmission antenna amplifies the electromagnetic radiation emitted by the at least one transmission antenna.

17. The method according to claim 15, wherein input parameters of the at least one food are forwarded to the control unit of the system, that the control unit controls the energy required to heat the at least one food at least by turning-on and -off the transmission antennae or by turning-on and -off high-frequency signal transmitters, wherein each transmission antenna is respectively operatively assigned one high-frequency signal transmitter.

18. The method according to claim 17, wherein the control unit reads, in the database of the system, cooking data of the at least one food based upon the input parameters of the at least one food, and, based upon this cooking data, generates radiation zones and radiation periods, adapted to the at least one food, inside the cooking chamber, by means of the transmission antennae by a corresponding targeted actuation of at least the transmission antennae or of the high-frequency signal transmitter.

19. The method according to claim 17, wherein at least the control unit, the transmission antennae, the power amplifiers or the high-frequency signal transmitters of the system are actuated by the control unit in such a way that radiation zones and radiation periods, adapted to the food positioned in the cooking chamber, are generated in the cooking chamber based upon a superposition principle by constructive interferences and destructive interferences of the waves of the electromagnetic radiation of the transmission antennae.

20. The method according to claim 15, wherein at least the input parameters of at least the food or of the cooking chamber are input via the setting device and are forwarded to the control unit, or wherein the input parameters of at least the food or of the cooking chamber are automatically determined by the system based upon at least the object recognition or the determination device, and are forwarded to the control unit.

21. The method according to claim 15, wherein for cooking the outer region of the at least one food till crispy, at least one of the transmission antennae or at least one additional transmission antenna is actuated by one of the high-frequency signal transmitters of the system or by at least one additional high frequency signal transmitter in such a way that the at least one of the transmission antennae or the at least one additional transmission antenna emits energy in the form of electromagnetic radiation in the terahertz range.

22. The method according to claim 15, wherein at least one of the transmission antennae, or multiple transmission antennae in groups, is/are at least moved or is/are pivoted about an axis of rotation through the actuation by the control unit.

* * * * *